US005505994A

United States Patent [19]

Crawford

[11] Patent Number: 5,505,994

[45] Date of Patent: Apr. 9, 1996

[54] FABRIC-HANDLING EQUIPMENT

[75] Inventor: Warren N. Crawford, Lincolnwood, Ill.

[73] Assignee: QST Industries, Inc., Chicago, Ill.

[21] Appl. No.: 214,093

[22] Filed: Mar. 16, 1994

[51] Int. Cl.[6] ..... B05D 1/32; B05D 5/00

[52] U.S. Cl. ..... 427/282; 101/424.1; 101/488; 271/16.3; 271/168; 432/5; 432/6; 432/8

[58] Field of Search ..... 271/18.3, 168; 427/282; 432/5, 6, 8, 230; 101/424.1, 488

[56] References Cited

U.S. PATENT DOCUMENTS

| | | | |
|---|---|---|---|
| 4,641,827 | 2/1987 | Walton | 271/18.3 |
| 4,684,120 | 8/1987 | Kamal | 271/18.3 |
| 4,939,992 | 7/1990 | Bird | 101/424.1 X |
| 5,039,078 | 8/1991 | Blessing et al. | 271/1 |
| 5,060,572 | 10/1991 | Waizmann | 432/8 X |
| 5,086,700 | 2/1992 | Berg | 101/424.1 |
| 5,115,741 | 5/1992 | Rodi | 101/424.1 |

*Primary Examiner*—Michael Lusignan
*Attorney, Agent, or Firm*—Eugene F. Friedman

[57] ABSTRACT

Fabric-handling equipment which removes a fabric web from a stack of such webs or from a supporting surface, dries ink printed on a fabric, and removes a porous fabric held onto a surface by a vacuum. To remove a fabric web from a surface, like a stack of such webs, a device places needles partially into the web. Since the needles extend into the fabric less than about nine tenths of the fabric's thickness, they can only attach to the upper surface of a single web. The needles, after insertion into the web, separate from each other to effectuate a firm connection. When the device raises, it can only lift a single web. When a fabric web receives printing, touching it with a heated block having a Teflon surface cures the ink. This permits its subsequent printing or collecting and stacking. A fabric web may adhere to a supporting surface through suction. Applying a greater vacuum through hoses located over the holes of the supporting surface overwhelms the retaining vacuum and attaches the web to the overhead hoses. Lifting the hoses then removes the porous fabric web without the necessity of turning off the vacuum in the supporting surface.

147 Claims, 11 Drawing Sheets

77
6
6
A
22
24
25
78
79
80
81
82
83
86
87
89
90
94
97
101
105
108
120
121
122
128
133
135
155
156
157
301

FABRIC-HANDLING EQUIPMENT

BACKGROUND

The automated handling and moving of fabric webs has proved especially troublesome because of their porous nature. The drying of wet printing placed on such fabrics has also provided difficulties when undertaken by continuously operated machinery.

Fabrics, of course, have to varying degrees a porous nature. This permits the passage of air through them with at least some, if not a substantial, degree of facility. This passage of air through fabrics has interfered with or even precluded their handling in the fashion of nonporous webs such as sheets of paper. For example, the application of a vacuum to the upper surface of a sheet of nonporous paper permits its easy handling and movement. Turning off the vacuum allows, after some short delay, the placement of the piece of paper where desired. This vacuum control of the movement of sheets of paper has found especial use in printing presses and in the placement of labels in a plastic molding cavity for bottles and other containers.

Vacuum handling has encountered significant roadblocks in its application to the handling of porous fabrics. The initial problem occurs in lifting a single layer of fabric off of a stack. This happens, of course, in moving a piece of material off from a stack of such pieces. A dye cutting operation performed on a cutting table holding a vast expanse of a multitude of layers of virgin fabric may produce the stacks.

The application of a sufficiently strong vacuum to the uppermost layer of a stack of fabric materials will, typically, suffice to at least remove the upper layer. However, the porosity of that upper layer permits the vacuum to travel down to succeeding layers and cause them to lift with the top layer. The vacuum may suffice to cause both layers to travel to the same destination, for example a printing press. Alternately, the second and succeeding layers may simply drop crumpled in place or along the route of travel. In the former instance, it almost completely precludes any handling of succeeding layers. In the latter, it at least constitutes an economic loss and requires the consumption of time for its clean up.

Even the removal of a single layer of fabric from a supporting surface may also present difficulties. A strong vacuum, passing through the fabric, may cause the transporter to adhere through the fabric to the underlying support surface. Or, a sufficiently strong vacuum may initially also cause the fabric to move on the support surface and experience a distortion in its configuration when the transporting vacuum approaches.

U.S. Pat. No. 4,684,120 to N. Kamal shows various devices which place needles into the top layer or layers of fabrics in a stack in order to remove a predetermined number of them. However, accomplishing the objective has proved difficult and even requires, in one of the embodiments, unattached needles passing through the layers of material to keep successive layers from undesired motion.

R. R. Walton et al.'s U.S. Pat. Nos. 4,641,827 and 4,645,193 show pick-up devices having rectangular gripping elements which stretch the layer of fabric and nip the edges between them. They may use needles on their bottom sides to assist in the stretching and nipping process. The nipping, however, provides the actual gripping necessary to elevate the fabric. To assure that only one layer of fabric moves, the device may also incorporate a blast of air through the top layer of fabric to keep the next layer stationary. Additionally, the motion induced in the top layer of fabric by the gripping elements may help to reduce the adhesion between the top and adjacent layers of fabric.

In their U.S. Pat. No. 5,039,078, H. Blessing et al. utilized a staggered or "shingled" stack of cloth parts. While holding down the second and subsequent parts in the stack, the picker, perhaps using needles, pulls the top layer off the stack for subsequent utilization. Optical sensors determines the location of the different sheets. However, as suggested above, this device requires the shingling or staggering of the stack in a reasonably predictable manner in order to operate effectively.

Typically, when a fabric receives sufficient ink or other colorant to make a visible pattern, the amount of moist solvent will not readily dry in air. Stacking sections of fabric with wet ink will simply cause the pattern on one layer to transfer inappropriately to other layers. Thus, after receiving the ink, each layer of fabric must undergo drying prior to further handling.

The most typical fashion for drying a printed pattern on fabric has involved placing the piece of fabric into an oven for a substantial period of time. The oven itself, the energy to maintain it at an elevated temperature, and the space required to keep a conveyor line of fabric sections within the oven all substantially add to the expense of printing fabrics.

Furthermore, subjecting a printed fabric, especially those with a finishing, to the heat of an oven results in the shrinkage of the cloth. The evaporation of the moisture of the ink will cause an uneven heating of the fabric and the resulting shrinkage. Thus the fabric may undergo a "puckering" in the oven while it dries.

Oftentimes, a vacuum will hold a piece of fabric onto a surface while it undergoes printing or other handling. The porosity of the fabric requires a substantial vacuum to hold it down. To remove the fabric would typically involve turning off the vacuum. A nonporous sheet of paper cannot be removed without the vacuum's cessation. However, because of the size of the vacuum, its cycling on and off may not meet the time strictures of the processing equipment. Furthermore, turning it off results in the loss of the vacuum almost immediately and the inability to hold the fabric for almost any length of time subsequently.

Accordingly, the rapid and automated handling and printing of fabric pieces requires the development of devices for lifting a layer off a stack of webs, drying printing on a fabric, and lifting a piece of fabric off a surface where a vacuum holds it down. Accomplishing these tasks will permit the efficient and inexpensive handling and printing of fabrics.

SUMMARY

The efficient lifting of a single layer of fabric whether upon a stack of such layers or upon a supporting surface results from the utilization of needles inserted less than about nine tenths through the fabric itself. The gripping of the fabric above its lower surface avoids disturbing or adhering the underlying layers of fabric. Moving the needles to extend the fabric attaches the fabric to the needles and permits the former's lifting.

More generally, a device for lifting a web of fabric from a stack of such webs or from a supporting surface first includes a plurality of at least three needles. A retaining device couples to the needles and holds them at three points in a first configuration. The points in the first configuration must not lie on a straight line. As a consequence, they define an area between them which should lie substantially parallel to the web.

The needles, when held by the retaining device, extend at a nonperpendicular to the surface of the web.

A grabbing device couples to the retaining device. It places the needles under pressure in contact with the web and no deeper into the web than nine tenths of the thickness of the web. It subsequently moves the needles away from the stack or supporting surface. As a necessary consequence of this, the needles can attach only to the web lying on top of the stack or some other supporting surface.

Lastly, an extending device couples to the retaining device. With the needles in contact with the web, the extending device moves the needles to a second configuration. In this configuration, at least two of the points at which the needles sit lie further away from each other than in the first configuration. The extending device then maintains the needles in the second configuration as the grabbing device moves the needles away from the stack or supporting surface. As the grabbing device moves the needles away, the fabric into the which the needles have attached then moves with it.

The method of removing a fabric web from on top of a stack of fabric webs or supporting surface commences with the placement of a plurality of at least three needles in contact and under pressure with the surface of the web at a nonperpendicular angle to the surface of the web and no deeper than nine tenths of the thickness of the web. When making this contact, the three needles occupy a first configuration in which they do not lie in a straight line.

While in contact with the surface of the web, the needles then move to a second configuration. In that configuration, at least two of the points in the second configuration lie further away from each other then in the first configuration. Finally, with the needles remaining in the second configuration, they move away from the stack or other supporting surface. As they do so, they take the web of fabric with them.

At some point in their handling, webs of fabric see printing placed on them. This often occurs through the process of silk screening. The printing leaves wet ink on the fabric which must dry prior to the further handling, collecting, and stacking of the webs.

A device to effectuate the drying of the wet printing on a portion of the web includes a section of material with a surface. A heating device couples to this surface and maintains it at an elevated temperature, A moving device then couples to the surface of the material. It places the surface, while heated to the elevated temperature, in contact with the printed portion of the web. This contact provides heat directly to the printing and effectuates its drying or curing at least to the point where the web can undergo further handling. Subsequent to the contact, the moving device removes the surface from the printed portion of the web.

The method of drying wet printing on a portion of a fabric web involves first heating the surface of the section of material to a predetermined temperature. A portion of the web of fabric is then placed in contact with the surface heated to the temperature for a period of time. Subsequently, the surface undergoes removal from the fabric web.

Often, the treatment of a web of fabric requires its adherence to a supporting surface. A common technique of assuring this adherence involves the use of a vacuum appearing at holes in the supporting surface. For a fabric web, because of its porosity, the vacuum must remain continuously in force. Turning off the vacuum even to remove the web may cause a delay in subsequent operations in order to redevelop the vacuum to a level where it can retain the next fabric web. Accordingly, a removing device will prove especially beneficial where it can extract the web from on top of the supporting surface without the necessity of turning off the adhering vacuum.

Removing a web of fabric from a supporting surface held there by a continuing vacuum involves overwhelming that suction through the application of a larger vacuum to the top of the fabric. This actually causes a reversal of the direction of the air passing through the fabric web and attachment of that web to the overhead vacuum source. This permits the removal of the fabric from the supporting surface without the necessity of stopping the vacuum that previously held the fabric to the surface.

The device must accomplish the removal of a porous web from a surface from where a first vacuum device applies a first negative partial pressure to the first side of the web in contact with the surface where that negative partial pressure retains the web at the surface. This device includes a second vacuum device for applying to the second side of the web a second negative partial pressure. To accomplish this objective, the second negative partial pressure must have a greater magnitude than the first negative partial pressure.

A moving device then couples to the second vacuum device. While the first vacuum device applies the first negative partial pressure to the first surface of the web and the second vacuum device applies the second negative partial pressure to the second side of the web, the moving device moves the second vacuum device away from the surface. Because of the greater suction provided by the second vacuum, this movement takes the fabric web off the supporting surface without the necessity of turning off the first vacuum.

The method of removing a porous web from a surface must overcome a first negative partial pressure which retains a first side of that web at the surface. The method proceeds with applying with a vacuum device a second negative partial pressure to the second side of the web. The second negative partial pressure has a greater magnitude than the first negative partial pressure. The application of the second suction occurs while the first suction retains the first side of the web to the surface.

While the vacuum device applies the second suction to the second side of the web, the vacuum device is moved away from the supporting surface to remove the web from it.

DETAIL DESCRIPTION

Figure 1:
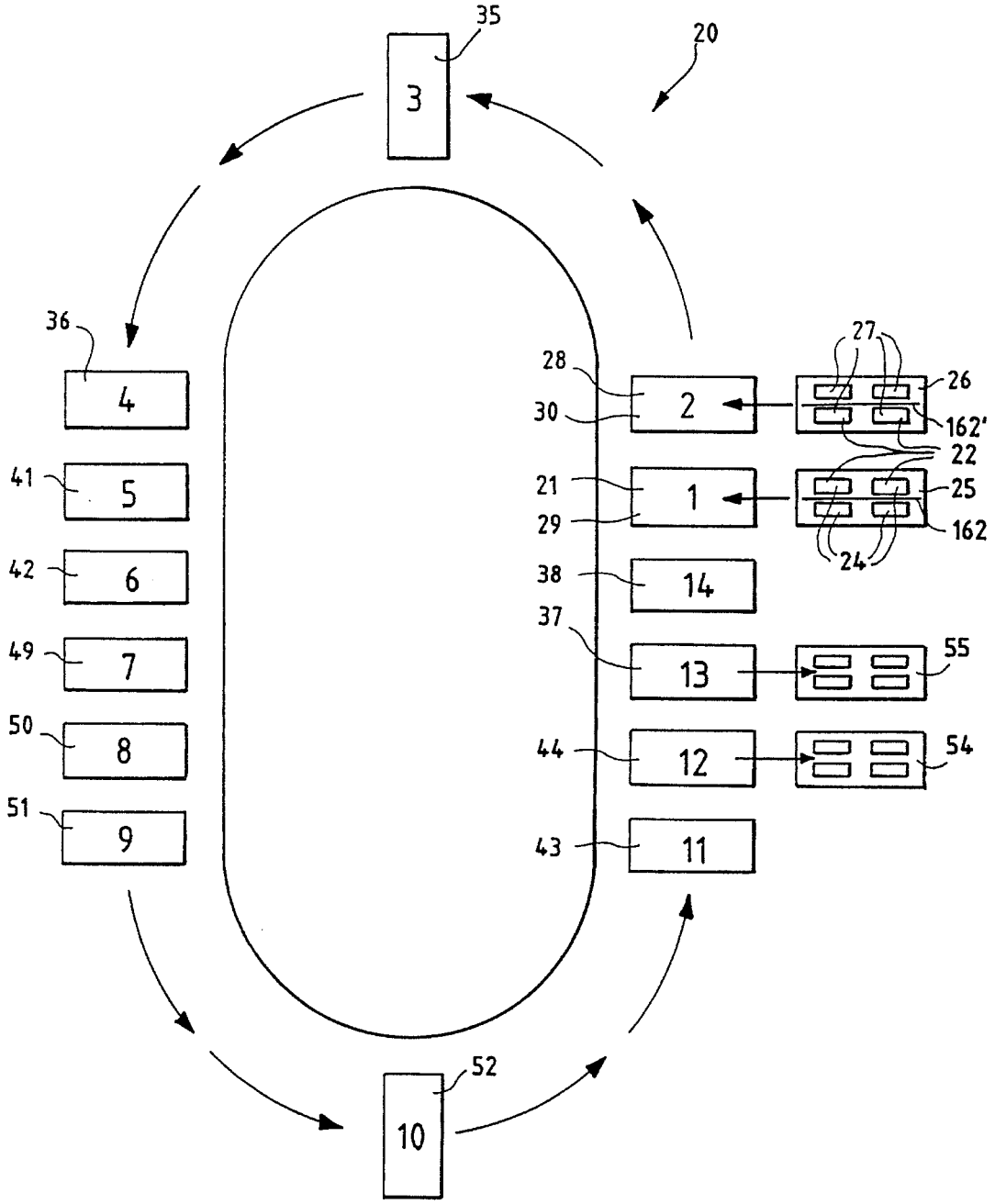
FIG. 1 gives a diagram of equipment that will load fabric webs from stacks of webs onto a printing press. It will then print and dry two separate colors onto the fabric. The webs will then be removed and stacked.

FIG. 1 shows generally the printing press 20 as provided by the Precision Screen Machines, Inc., of Hawthorne, N.J., model V090-S/1. This equipment permits the insertion of as many stations as necessary along the left and right sides, as in the figure.

As seen in FIG. 1, the first station 21 carries the four pieces 22 of fabric on top of the four stacks 24 sitting at the first supply station 25. Similarly, the second supply station 26 has the four stacks 27 which provides the pieces 22 of fabric to the second station 28. Specifically, the fabric sits on the pallets 29 and 30 at the first and second stations 21 and 28, respectively.

Each pallet at the various stations moves two stations during each cycle of motions. Thus, the pallet 29 at the first station 21, after receiving four pieces 22 of fabric from the stacks 24, will move two stations to the third station 35. Also, the pallet 30 at the second station 28 moves to the fourth station 36. In the configuration as shown, after the first motion, nothing will occur at the third station 35. However, the fabrics 22 on the pallet 30 that had started at the second station 28 end up at the fourth station 36 where it receives printing in the first color. Naturally while this occurs, the two pallets 37 and 38 have moved to the first stations 21 and 28 and received pieces of fabric.

The next motion cycle will bring the first pallet 29 to the fifth station 41 where it receives printing in the first color, for example red. At the same time the second pallet 30 has moved to the sixth station 42 where the first color undergoes curing through the contact with a heated metal block. Although the two pallets 29 and 30 that started out together now seem out of sequence, they will come back into sequence subsequently as discussed below.

Again, while the original two pallets 29 and 30 have undergone operations at the fifth and sixth stations 41 and 42, the two pallets that had started out at the eleventh and twelfth stations 43 and 44 now receive their pieces of fabric at the first and second stations 21 and 28.

The fourth cycle of motion then brings the original pallets 29 and 30 to the seventh and eighth stations 49 and 50, respectively. There, the pieces of fabric on the second pallet 30 receives the printing in the second color, for example black. Also, the fabric webs on the first pallet 29 have the first color dried by contact with a heated block.

The fifth cycle of motion brings the pallets 29 and 30 to the ninth and tenth stations 51 and 52 respectively. The pieces 22 of fabric on the second pallet 30, now at the tenth station 52, have the second ink dried while the fabrics 22 on the first pallet 29 receive the second ink. The sixth cycle of motion brings the two pallets 29 and 30 to the eleventh and twelfth stations 43 and 44, respectively. The fabrics 22 on the second pallet 30 undergoes removal to the receiving stack 54 from the twelfth station 44. The pieces 22 of material on the first pallet 29 have the second color dried at the eleventh station 43.

The sixth cycle of motion brings the second pallet 30, now empty, to the fourteenth station 38 where, of course, nothing happens. At the same time, however, the first pallet 29 goes to the thirteenth station 37 from where its fabric materials 22 move to the receiving location 55. The seventh cycle of operation takes the first pallet 29 back to the first station 21 and the second pallet 30 back to the second station 28.

The program of the computer controlling of the printing press 20 provides start-up and shut-down modes. It assumes, at beginning, that all of the pallets at the 14 stations have nothing on them. In the first stage of operation, the only action that takes place involves the loading of the fabrics from the stacks 25 and 26 onto the first two pallets 29 and 30. Nothing else occurs since no other pallet has fabric pieces on it.

The program then keeps track of when a pallet with a fabric loaded from either of the stacks 25 or 26 will reach an operational station. Only during the stage when that has occurred will a particular station go into operation. Thus, the printing of the second color at the ninth station 51 will occur only after the fourth cycle of motion which will bring the first pallet 29 with fabric on it to that station. Up to that time at start-up, the ninth station remained inactive. Similarly, the shut-down mode will stop loading fabrics at the first two stations 21 and 28. As each of these empty pallets go to the different stations, those operations that would occur there stop since those pallets, and the succeeding ones, have no materials on them.

Figure 2:
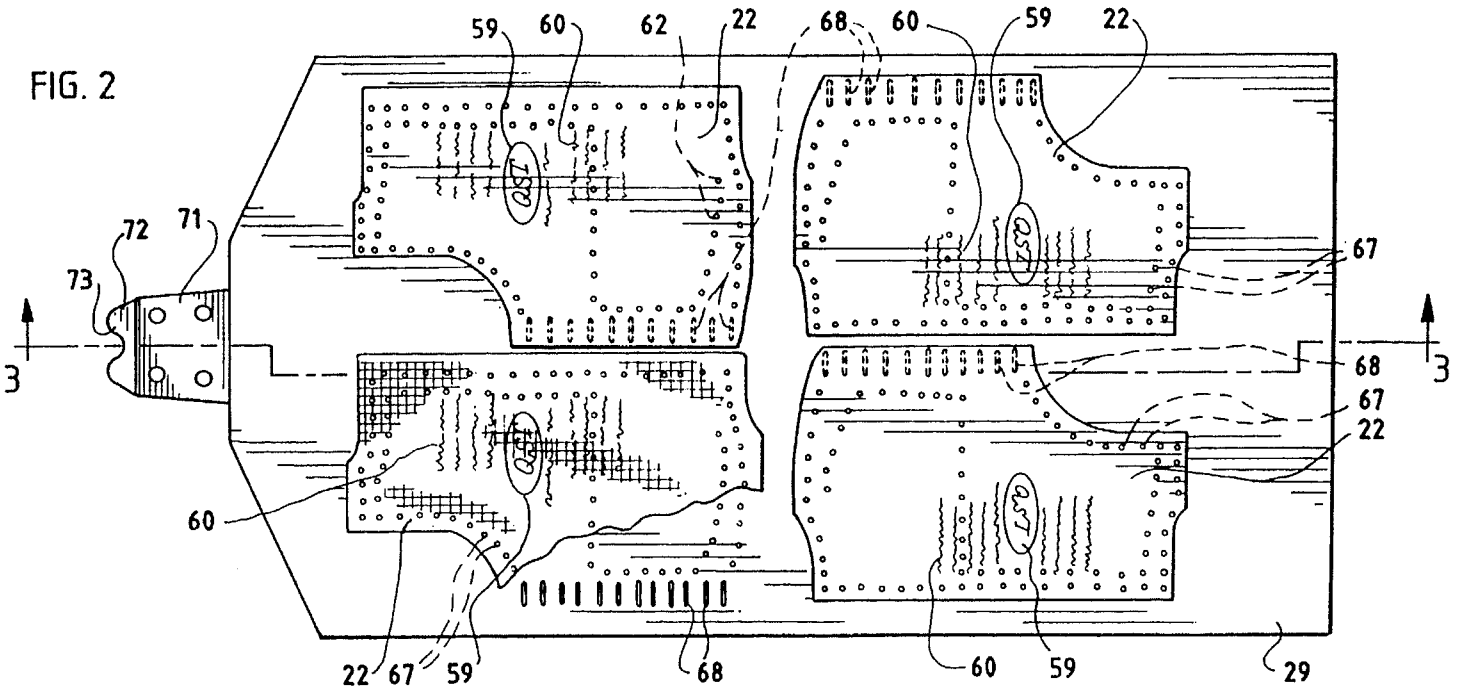
FIG. 2 gives a top plan view of a pallet holding four webs of fabric with printing upon them.
Figure 3:
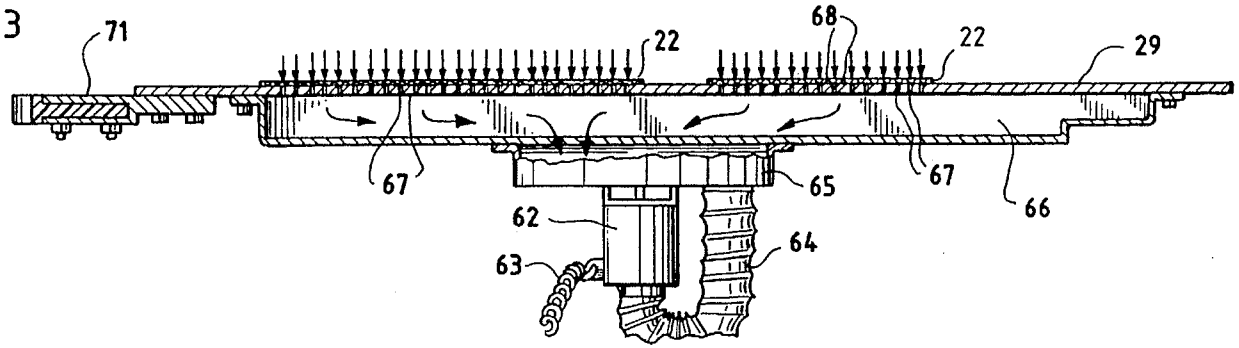
FIG. 3 gives a cross sectional view along the line 3—3 of the pallet shown in FIG. 2.

The pallet 29 that receives the four pieces 22 of fabric appears in FIGS. 2 and 3. In fact, the pieces 22 of fabric have undergone the operations of the printing press 21 and now appear ready for unloading at the removal station 37 onto the receiving bin 55. In particular, the pieces of fabric 22 may include the QST logo 59 in a first color such as red which it received at the fifth, or printing, station 41.

Small heated blocks at the seventh, or curing, station 49 may have dried the printing and prepared it for the black printing 60 which may constitute information about the manufacturer. The pieces of fabric 22 received the black printing at the ninth station 51 and underwent curing at the eleventh station 43.

As seen more clearly in FIG. 3, the pallet 29 includes the vacuum motor 62 which operates continuously on electricity supplied from the cord 63. The printing press 20 of FIG. 1 provides a contact around its periphery so that the lead 63 receives electricity at all time to allow the continuous operation of the vacuum motor 62. The vacuum developed by the motor 62 appears through the hose 64 to the subplenum 65 and from there to the main plenum 66. The suction in the main plenum 66 passes through the openings 67 to keep the fabric webs 22 onto the pallet 29. The elongated grooves 68 provide extra suction along the short edges of the fabric pieces 24.

Lastly, the pallet 29, as do the other pallets, includes the cam 71 at its left, or outer, edge. The cam 71 includes the attached piece of plastic 72 with the notch 73. A roller at each station of the printing press 21 will fit into the notch 73 to properly locate the pallet and inform the press' computer that each pallet has stopped at the appropriate location for each station.

Figure 4:
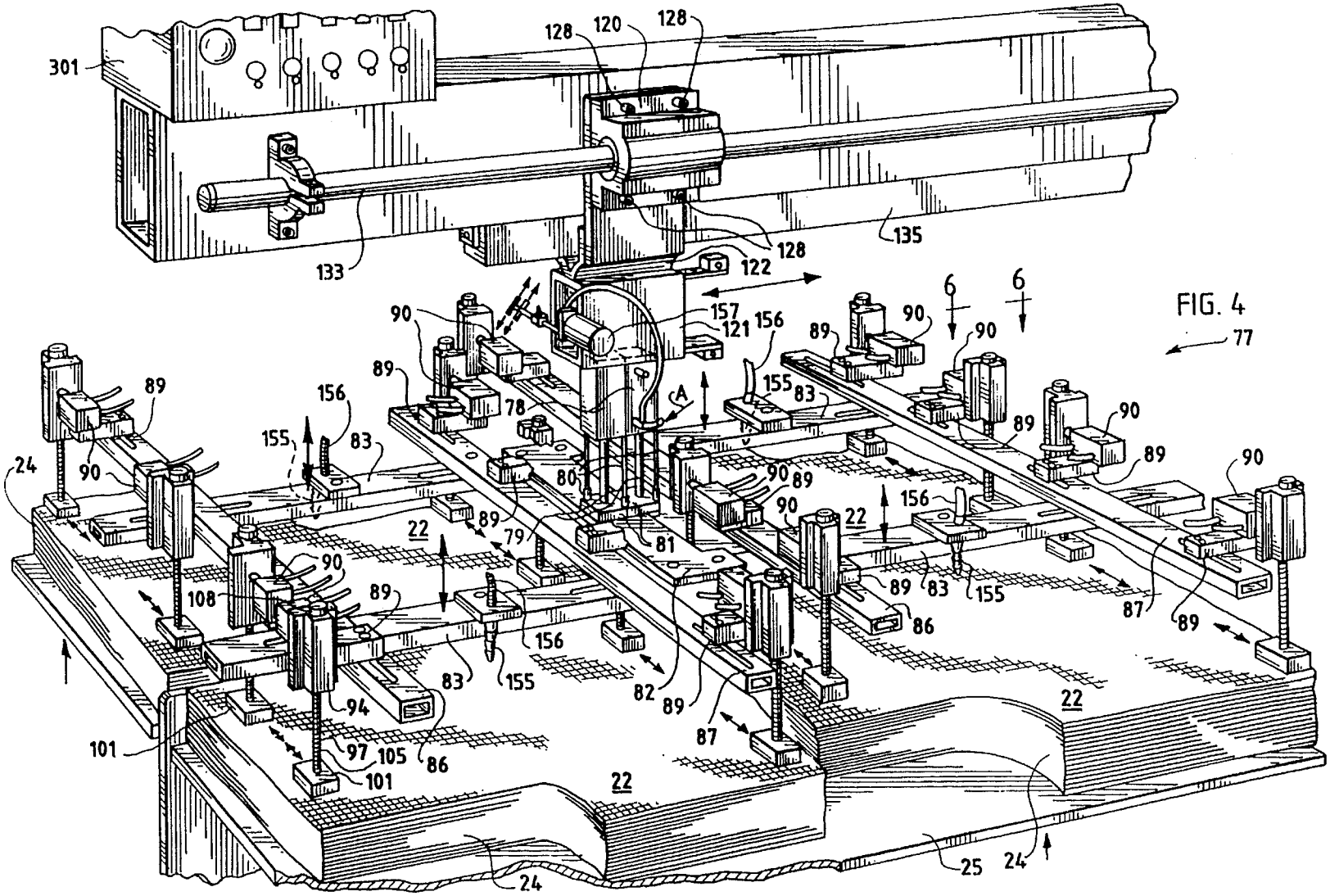
FIG. 4 provides an isometric view of loading equipment that can remove the upper layer on four stacks of fabric webs.
Figure 5:
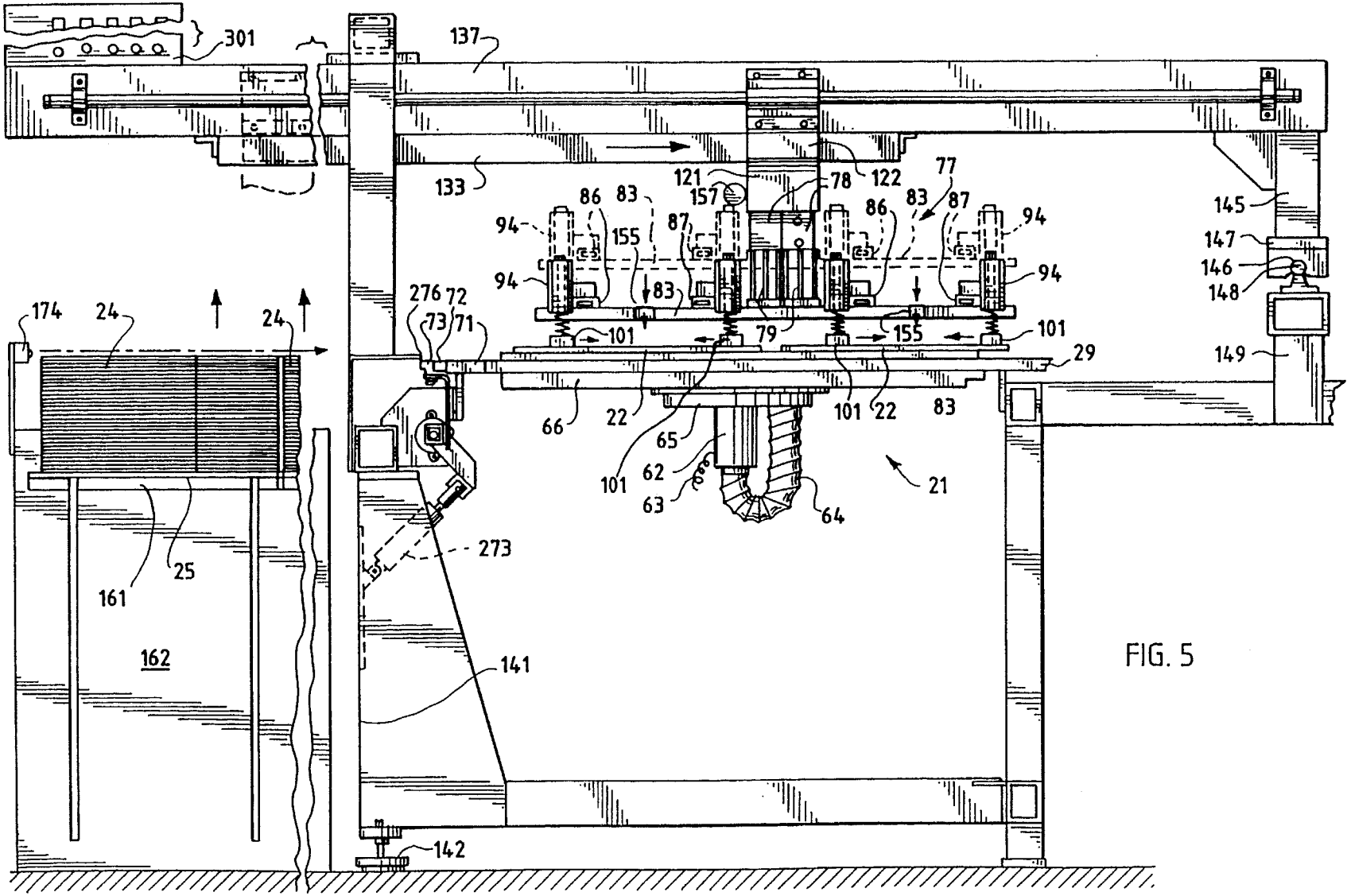
FIG. 5 provides a side elevational view of the loading equipment of FIG. 4.
Figure 6:
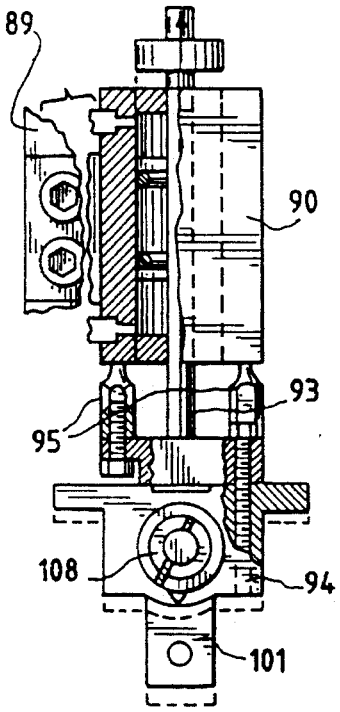
FIG. 6 provides a top plan view of a needle holder along the line 6—6 of the loader in FIG. 4.

The equipment for moving the top layers 22 of fabric off the stacks 24 onto the pallet 29 at the first station 21 in FIG. 1 appears generally at 77 in FIGS. 4 and 5. To start the grabbing of the fabric pieces 22 from off the stacks 24, the pneumatic cylinders 78 extend their pistons 79. The pistons 79 and the rods 80 connect to the rectangular tabs 81 which securely, in turn, attach to the cross bar 82. As the cylinders 78 extend the pistons 79, the cross bar 82 also descends and takes with it the long irons 83 to which attach the cross irons 86 and 87. In turn, the blocks 89 attach to the cross irons 86 and 87 and provide rigid connections for the cylinders 90. As seen in FIG. 6, the piston 93 of the cylinder 90 connects to the channel member 94. The idler rods 95 prevent rotation between the channel number 94 and the cylinder 90.

Figure 7:
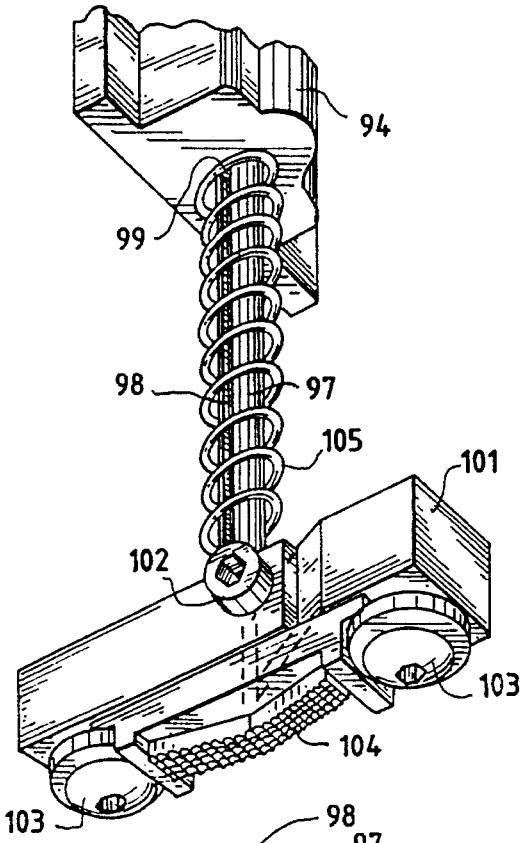
FIG. 7 provides a large isometric view from below of the needles with its holder of the loader of FIGS. 4 to 6.

As FIG. 7 shows, the rod 97 moves up and down in the channel member 94. The groove in the rod 97 fits around the tab 99 in the channel member 94 to prevent relative rotation between the rod 97 and the channel member 94. The rod 97 in turn connects to the needle holder 101 where the bolt 102, which passes into the needle holder 101, keeps it in place. The bolts 103 then hold the needle assembly 104 against the needle holder 101. The spring 105, as well as the weight of the needle holder 101, keeps the needle holder 101 extended away from the channel member 94.

The cylinders 78 lowering their pistons 79 causes, because of the above connections, the channel members 94 to descend until the needle assemblies 104 make contact with the top webs 22 of fabric on the stacks 24. As the pistons 79 continue to lower to their full extension, the needle holders 101, now in contact with the stacks 24, push the rods 97 up into the channel members 94 against the force of the spring 105. The flexibility provided by the rods 97 traveling within the channel members 94 provide some degree of flexibility as to the exact location of the tops of the stacks 24. The nuts 108 at the top of the rods 97 keep them from passing out of the channel members 94 in a downward direction if the needle holders 101 make no contact with the stacks 24.

Upon the extension of the pistons 79 from the cylinders 78, the needles 111 of the assembly 104 contact the web 22. They are forced somewhat into the web 22 by the weight of the needle holder 101 and the rod 97. However, since they make an angle of about 25 degrees, they do not penetrate very far. Furthermore, the spring 105 provides additional force to cause the needles 111 to enter at least the top of the web 22. The needles 111 however cannot penetrate more than nine tenths of the way through the web since the angle at which they are held limits their downward motion after contacting the web's upper surface. Preferably, the needles penetrate no further than about half of the web's thickness.

Figure 8:
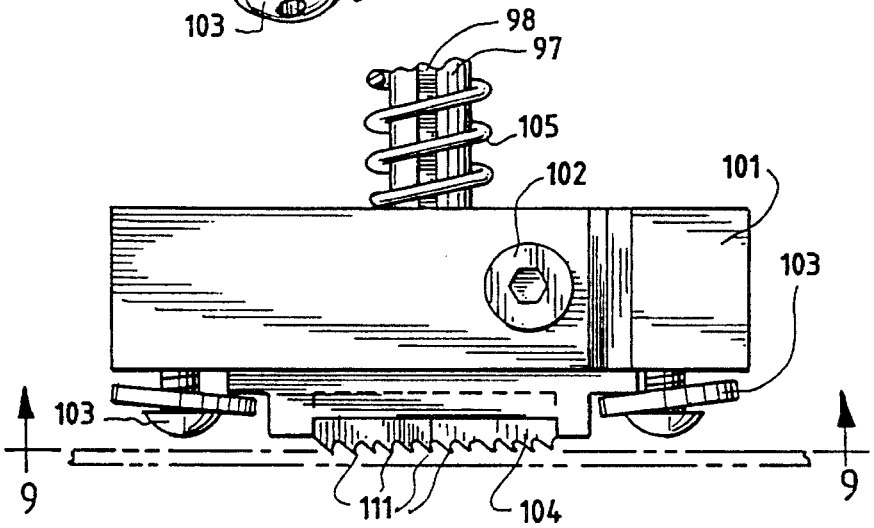
FIG. 8 gives a side elevational view of the needles and holder of FIG. 7.
Figure 9:
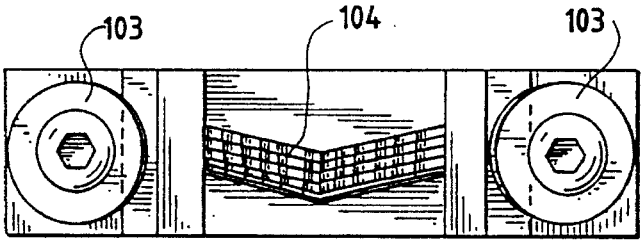
FIG. 9 provides a bottom plan view of the needles and holder along the line 9—9 of FIG. 8.

With the needles 111 in the assembly 104 placed in contact with the webs 22, the cylinders 90 move the channel members 94 and thus the needle assemblies 101 towards the edges of the fabric. This moves them in the direction that the needles 111 point. Thus, in FIG. 8, the needle holder 101 would move to the right. This helps assure that the needles 111 effectively penetrate the surface of the webs 22. Furthermore, because two opposed needle holders 101, such as those shown in the lower left section of FIG. 4, move away from each other, they also have the effect of stretching the fabric web 22 between them. This penetration and stretching as-the two needle holders 101 move away from each other cause the needles 111 to achieve a secure grip on the top layer 22 of fabric on the stacks 24. As seen in FIG. 4, this penetrating and stretching occurs at the left and right sides at each of the stacks 24.

Because the loader 77 has secured the left and right sides of the top web 22 on each of the stacks 24, it in effect has a complete hold on the web 22. The retraction of the pistons 79 by the two cylinders 78 will lift the entire loader mechanism 77. As this occurs, it takes with it the top layer 22 from the stacks 24.

Figure 10:
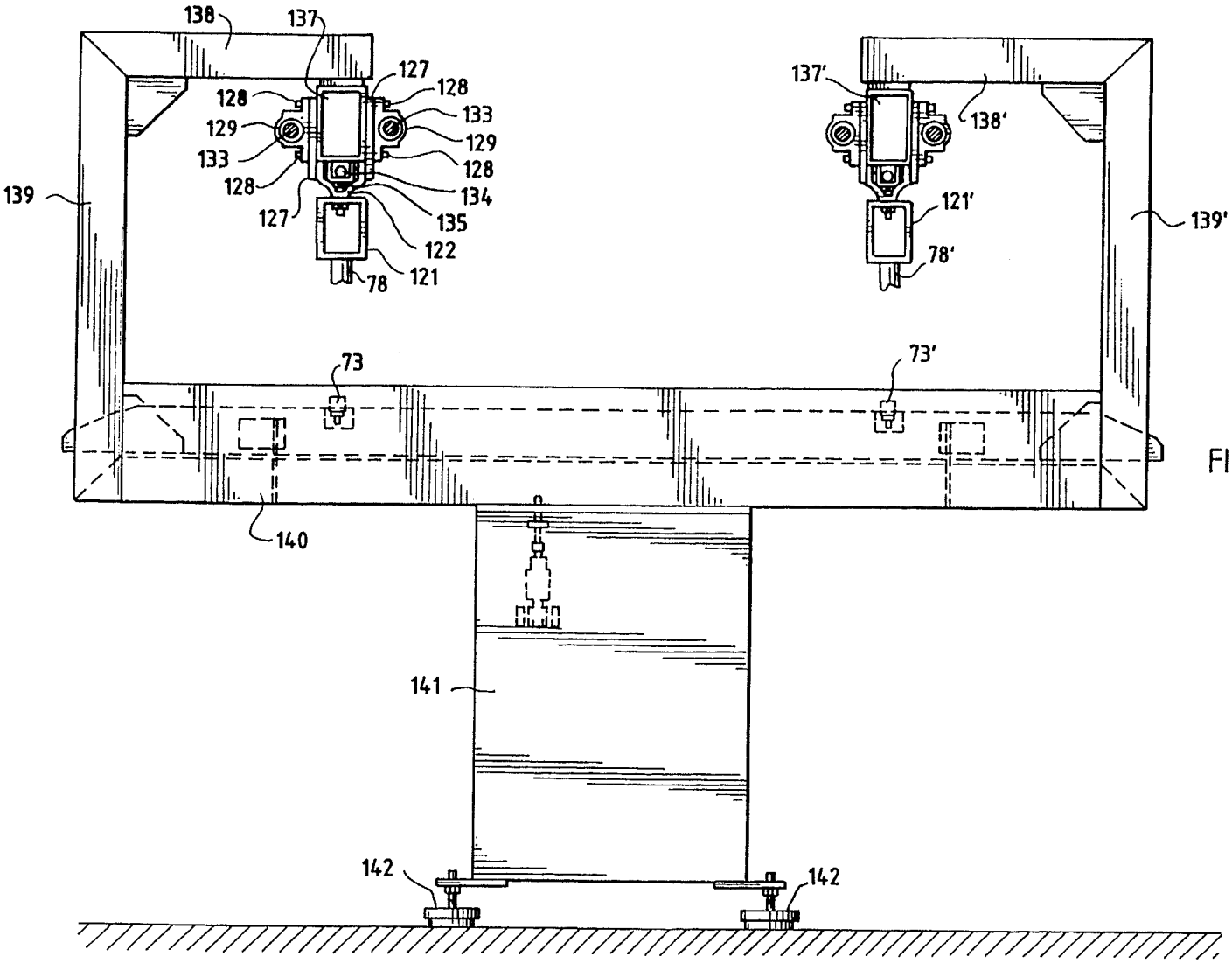
FIG. 10 gives an end elevational, cross-sectional view of the supporting structure for the loader of FIGS. 4 and 5.

The two cylinders 78 attach to the box beam 121 which thus supports the entire weight of the loader 77 plus the four layers 22 of fabric. The box beam 121 in turn attaches to the V beam 122. As seen in FIG. 10, the V beam 122 attaches to the two plates 127. The four bolts 128 then attach the bearings 129 to the plates 128. The bearings 129 sit on and thus distribute the weight to the bars 133. This appears particularly in FIG. 10 which shows the same assembly for the second loader 78'.

To effectuate motion of the box beam 121 and thus the loader 77, the V beam 122 attaches to the piston 134 which sits in the Tol-O-Matic cylinder 135, model BCL 100-100, manufactured by Tol-O-Matic, Inc., of Minneapolis, Minn. In turn, the Tol-O-Matic cylinder 135 also attaches to the support beam 137 as do the bars 133.

Providing air pressure to the Tol-O-Matic cylinder 135 causes its piston 134 to move in the longitudinal direction. This direction takes the loader 77 left to right and return in FIGS. 4 and 5 which translates to into and out of the paper in FIG. 10.

Although FIG. 10 shows the two bars 133 bearing the weight of the loader 77, that depends upon the total weight of the loader assembly 77, the box beam 121, and the V beam 122. If they impose minimal weight, perhaps only one or even no weight-bearing bars 133 may prove necessary. In that case, the entire weight of the assembly would rest upon the piston 134 by itself or with the assistance of a single bar 133. After the loader 77 has lifted the four upper layers 22 of the stacks 24, the cylinder 133 may move it to the right as seen in FIG. 5.

As seen in FIG. 10, the box beam 137 has a rigid attachment to the overhead beam 138 and it to the vertical beam 139. The vertical beam 139 in turn connects to the base beam 140 which affixes to the base 141. The adjustable feet 142 permit the leveling of the structure.

The descending beam 145 also attaches to the box beam 137 and has the groove 146 in its foot 147. The groove 146 then sits on the bar 148 which in turn connects to the short beam 149, rigidly affixed to the supporting structure of the printing press.

When the Tol-O-Matic cylinder 133 has pushed the loader 77 to the right as seen in FIG. 5, it occupies a position over the pallet 29 which has stopped at the first, or loading, station 23 as seen in FIG. 1. At this point, it unloads its four pieces of fabric 22 onto the pallet 29 where the suction developed by the motor 63 will retain it. Accomplishing this requires the reversal of the motions that permitted the loader 77 to initially grab onto the four pieces in the fashion discussed above. To achieve this, the cylinders 78 extend their pistons 79 which lower, in effect, the long irons 83. As seen in FIG. 5, this causes the long irons 83 and the associated components such as the channel members 94 to move from the upper configuration shown in phantom to the lower configuration shown in solid lines. The associated pairs of needle holders 101 with their attached needles then move toward each other as seen by the arrows in FIG. 5. This serves to disengage the needles from the underlying pieces of fabric 22.

As seen in FIGS. 4 and 5, the long irons 83 also have the nozzles 155 attached to them. These nozzles 155 receive an air supply through the hoses 156 which in turn connect to and operate under the control of the valve 157, a model R711 pulse valve obtained from Clippard Instrument Laboratory, Inc., of Cincinnati, Ohio. Once the needle holders 101 have moved towards each other, the valve 157 provides a brief puff of air of around 5 to 6 pounds of pressure through the nozzles 155. This pulse of air will complete the disengagement of the fabric webs 22 from the loader assembly 77. At this point, the loader 77, now free of its pieces of fabric 22, may now raise to the configuration shown in phantom in FIG. 5. From there, it can return to the left where it then sits over the stacks 24 of fabric. It can then descend to start the cycle over again.

Figure 11:
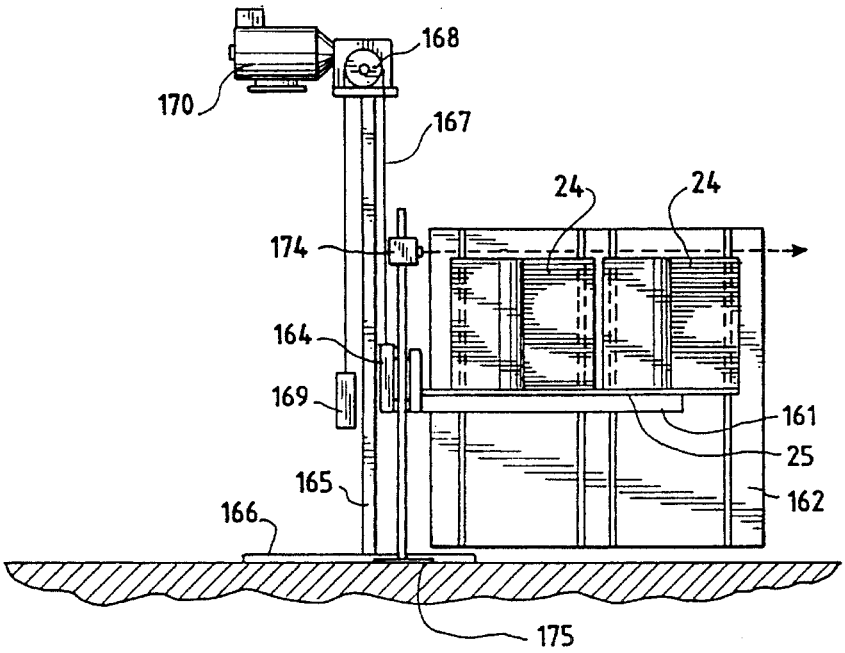
FIG. 11 gives a side elevational view of a stack holder and elevator that will provide layers of fabric at an appropriate height from which the loader of FIGS. 4 and 5 can move them onto the printing press of FIG. 1.

As seen in FIGS. 5 and 11, the stacks 24 of fabric webs sit upon the shelf 25. That in turn has the structural support of the horizontal beam 161. The plate 162 sits between two stacks 24 of fabric on one side and two stacks 24 on the other side to keep them from interfering with each other.

As FIG. 5 shows, the loader 77 has a limited range of motion. Thus, it cannot reach down very far over the stacks 24 to pick up webs of fabric. Since the loader 77 will not go to the webs, the webs will come to the loader 77. This requires, in effect, the raising of the shelf 25 and its supporting beam 161 in FIGS. 5 and 11. To accomplish this, the supporting beam 161 attaches to the bracket 164 which slides vertically on the vertical rod 165 affixed to the stand 166. The chain 167 then attaches to the bracket 164, passes over the gear wheel 168 and has its free end held down by the weight 169. The motor 170, a model 4Z248B from the Dayton Electric Mfg. Co., of Chicago, Ill., operates through a 60:1 reducing model F721-60-B5-G gearbox (from Boston Gear, Inc. of Quincy, Mass.) to turn the wheel 168 in the direction to either lower or raise the bracket 161 as necessary. It will do so to keep the tops of the stacks 24 at about a height that the loader mechanism 77 can reach them.

The motor 170, in turn, operates under the control of the optical sensor 174 attached to its own stand 175. The optical sensor 174, a model UD-A from Tri-Tonics, Inc., of Tampa, Fla., can see whether the stack has reached its height. If not, it will cause the motor 171 to turn the gear wheel 168 in the direction to bring the top of the stacks 24 up to the lever of the sensor 174. At that height, the loaders 78 can reach and grab the top layers 22 of fabric on the stacks 24.

Figure 12:
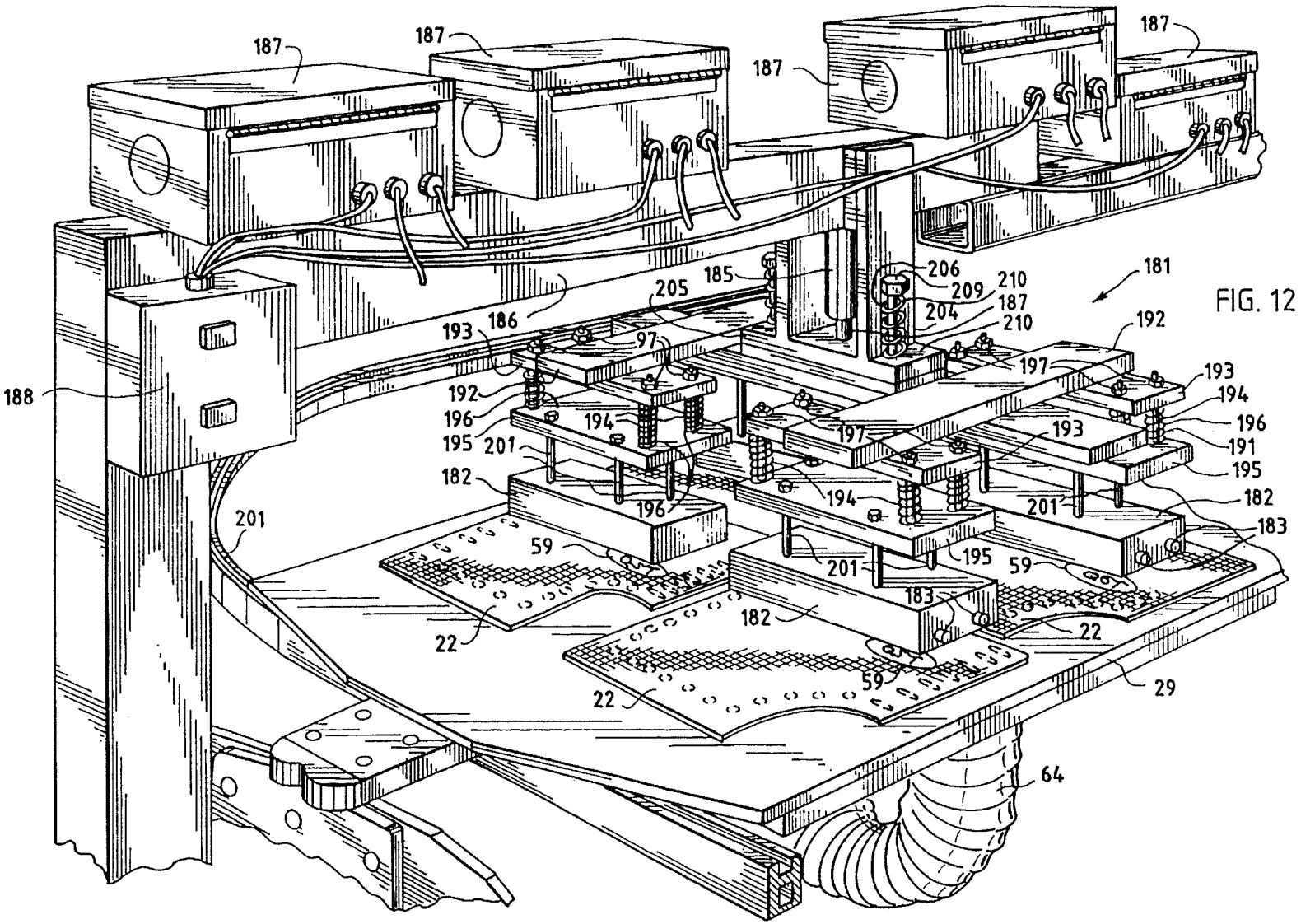
FIG. 12 provides a perspective view of drying equipment that can effectuate the curing of ink on fabric webs.

Returning to FIG. 1, the fabric webs placed on the pallet 29 at the first loading station 23 will travel, after two cycles of motion, to the fifth station 41 where it receives a printing in a first color. In FIGS. 2 and 12, this may constitute the "QST" logos 59 printed, for example, in red. This printing may utilize a water-based, two-part, cross-linking ink obtained from Perfectos Mills in Nottingham, England, as Aquascreen TP-AC. To permit further handling of the fabric pieces 22, the printed logos 59 will undergo drying at the seventh station 49.

Figure 13:
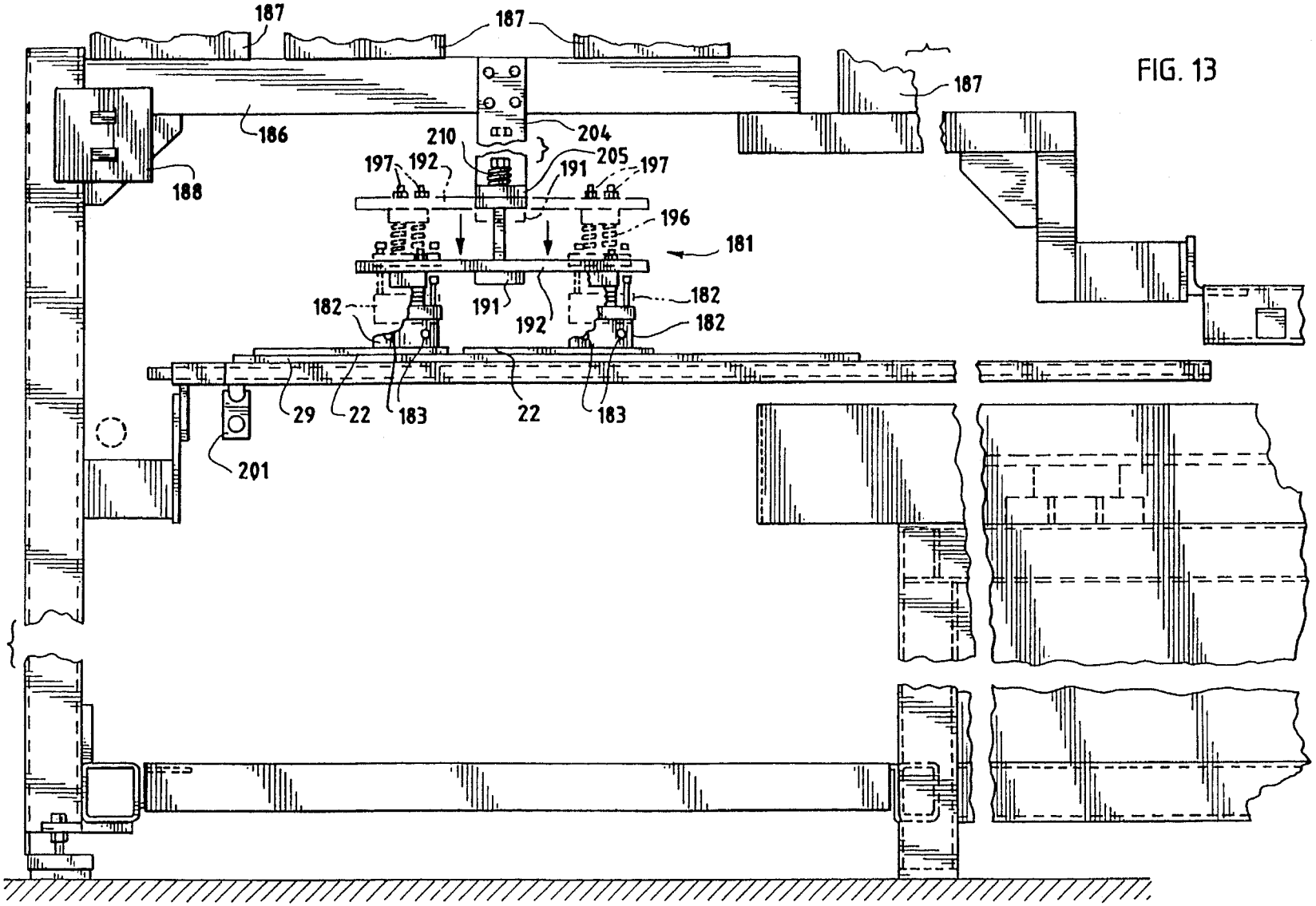
FIG. 13 gives a side elevational view of the drier of FIG. 12 along with its supporting structure.

The drying apparatus to accomplish this task appears generally at 181 in FIGS. 12 and 13. As seen there, the drier 181 includes the four aluminum blocks 182 which have a limited size to cover substantially only the printed logos 59. Thus, any effect it may have upon the fabrics 22 will be limited to the area of the printed logo 59. It clearly need not extend over any greater portion of the fabrics 22. The bottom of the blocks 182 may have a coating of a Teflon polymer.

The blocks 182 each include the two embedded heaters 183 such as those manufactured as part MWFX325-XZ by Ogden Mfg. Co. of Arlington Heights, Ill. The heaters operate on 24 volts at 90 watts each. They maintain the blocks 182 at a temperature of about 400° F. The heaters 183 in each of the blocks 182 connect to one of the controllers 187 which maintain the desired selected temperature. Suitable controllers are obtainable from the Watlow Controls Co. in Winona, Minn., as model 965A3CAO. The on-off switch 188 provides a single control for all of the heating of the drier 181.

To effectuate the actual drying, the blocks 182 make contact with the fabric webs 22. This requires them to lower onto those pieces of material. To achieve this motion, the cylinder 185 connects to the overhead beam 186. The piston 187 of the cylinder 185 then attaches to the support plate 191 which in turn connects to the cross bars 192. Extending the piston 187 from the cylinder 185 results in the lowering of the cross bars 192. Similarly, retracting the piston 187 back into the cylinder 185 will raise the cross bars 182.

The cross bars 192 in turn have a rigid attachment to the upper plates 193. The rods 194 then attach this to the lower plates 195. The rods 194 may move up and down in openings in the upper plate 193. To move upwards, however, they have to overcome the resistance of the springs 196. The bolts 197 screw into the tops of the rods 194 and prevent them from exiting entirely from the lower plates 195. In turn, the rods 201 rigidly connect the lower plates 195 to the blocks 192. As the cylinder 185 disgorges the piston 187, the blocks 182 lower onto the fabric webs 22. When they make this contact, then the rods 194 can ride up through the openings in the plate 193. This, of course, will cause the plates 195 moving upward to operate against the compression of the spring 196. The springged connection between the plates 193 and 195 permits an application of the weight of the blocks 192 plus the force of the springs 196 to the fabric webs 22. Yet, it avoids any damage that could result from a rigid connection between the blocks 182 and, ultimately, the piston 187 and the cylinder 185.

After the blocks 182 have remained in contact with the webs 22 for a length of time to at least initiate the curing of the printed matter 59, perhaps four seconds, they must then raise to allow the pallet 29 to move to the next station. As the pallet moves, it receives the support of the rail 201 forming part of the press 20. To lift the drier 181 simply requires the retraction of the pistons 187 into the cylinder 185, This will cause the support plate 191, the cross bars 192, the upper plate 193, the lower plate 195, and ultimately the blocks 182 to move upward away from the fabric webs 22.

As further seen in FIGS. 12 and 13, the bracket 204 attaches to the overhead beam 186. It also has the flanges 205 extending laterally at its bottom. The piston 187, incidentally, passes through an opening in the bottom of the bracket 204.

The rods 206 then pass through Openings in the flanges 205 and connect to the support plate 191. The nuts 209 prevent the rods 206 from passing out of the flanges 205.

The springs 210 pushed against both the flanges 205 and the nuts 209 to urge the latter upward. The force of the extension spring 210 thus provides an upward force to the drier mechanism 181. This serves to take at least a portion of the weight of the drier 181 off of the piston 187. The cylinder 185 thus need develop less force to move the drier upward because of the assistance of the springs 210. Further, a failure of the cylinder 185 for any reason will cause the springs 210 to raise the drier 181.

After the curing of the inked design 59 by the drier 181, the webs 22 on the pallet 29 then transfer to the ninth stage 51 in FIG. 1. There, they receive the second colored ink which creates the printed design in FIG. 2. Specifically, the written material 60 may be applied to the fabrics 22 through the usual silk screening process.

The second inking must also then undergo curing before the further handling of the webs 22. The next cycle of motion then takes the pallet 29 with its fabric webs 22 to the eleventh stage 43 where a drier similar to the apparatus 181 in FIG. 12 achieves that result. However, the drier at the eleventh stage involves the use of larger blocks than the blocks 182 in FIGS. 12 and 13. This results from the fact that the second inking 60 covers a larger area on the fabric webs 22 than does the initial inking 59.

Stated in other words, the heated blocks curing the ink on the fabric webs 22 need only present an area to the webs slightly larger than the area covered by the ink itself, This reduces the portions of the fabric webs 22 exposed to the heat and which might experience shrinking. This has particular importance for fabric having a thermoplastic finishing which can display substantial shrinking when heated in an oven or under infrared lamps.

Figure 14:
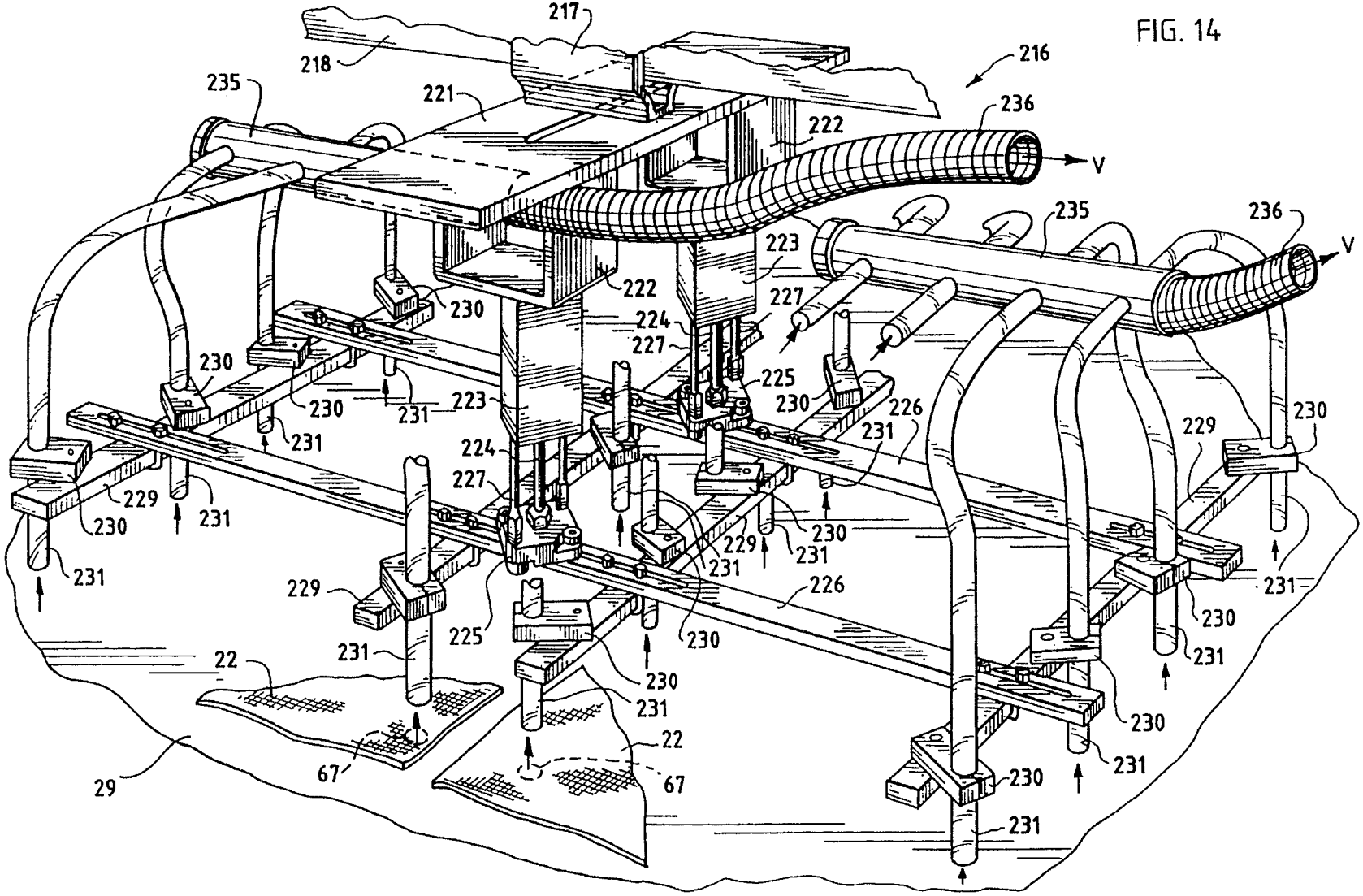
FIG. 14 illustrates an unloading apparatus that will remove webs of fabric from a pallet where held down by a vacuum.

After undergoing the second drying for the second ink at the eleventh stage 43, the next cycle of motion takes the pallet 29 with its webs 22 to the thirteenth stage 37 in FIG. 1 for off-loading onto the bin 55°. The apparatus to accomplish that task appears generally at 216 in FIG. 14. There, the V bracket 217 again attaches to a piston within the Tol-O-Matic cylinder 218. To remove the webs 22, the cylinder 218 moves its piston and thus the V bracket 217 to the right as shown in FIG. 14. If the weight of the unloader 216 proved excessive, the bracket 217 could have a connection to weight-bearing rods similar to the rods 133 in FIG. 4.

The V bracket 217 in turn connects to the cross plate 221 to which the U brackets 222 attach. The cylinders 223 then are affixed to the U brackets 222. The pistons 224 then attach to the metal squares 225, themselves rigidly connected to the cross beams 226. The idler rods 227 also connect to the square metal pieces 225 and ride within the housing of the cylinder 223. They provide rotational stability for the metal squares 225 relative to the housing of the cylinder 223.

The support bars 229 then connect to the cross bars 226. They provide support for the holders 230 which grab the ends of the hoses 231. Thus, when the cylinders 223 extend the pistons 224, the cross beams 226, the support beams 229, and the hose holders 230 and the hoses 231 move downward. This downward motion continues until the hoses 231 make contact with the webs 22. Preferably, the openings of the hoses 231 overlie at least some of the holes 67 in the top of the pallet 29 which provide the suction to hold down the webs 22.

The hoses 231 in turn connect to the manifolds 235. These then couple to the tubes 236 which connect to a source of vacuum.

Thus, the vacuum appearing on the tubes 236 travel through the manifolds 235 to the hoses 231 in contact with the webs 22. The vacuum provided through the hoses 231 overcomes the suction holding the webs 22 onto the pallet 29. In fact, the vacuum appearing in the hoses 231, by overpowering the suction in the openings 67, actually cause a reversal of the flow of air through the porous webs 22. Thus, before the hoses 231 contact the webs 22, the air flows downward through the fabric webs 22 and into the opening 67. With the hoses 231 in contact with the webs 22, the air actually flows from the opening 67, through the fabric webs 22, and into the hoses 231. The greater vacuum in the hoses 231 thus causes the fabric webs 22 to adhere to them. This occurs without turning off the vacuum from the motor 62 on the bottom of the pallet 29 in FIG. 3.

Retracting the pistons 224 into the cylinders 223 then lifts the fabric webs 22 off the pallet 29. The V bar 227, with its connected piston and under the action of the Tol-O-Matic cylinder 218, then moves over to the collection bin 55 at the thirteenth stage 37 of the press 20 of FIG. 1. Lowering the pistons out of the cylinders 223 and turning off the vacuum at the hoses 231 then allows the webs 22 to disengage from the unloader 216 and deposit into the bin 55.

Figure 15:
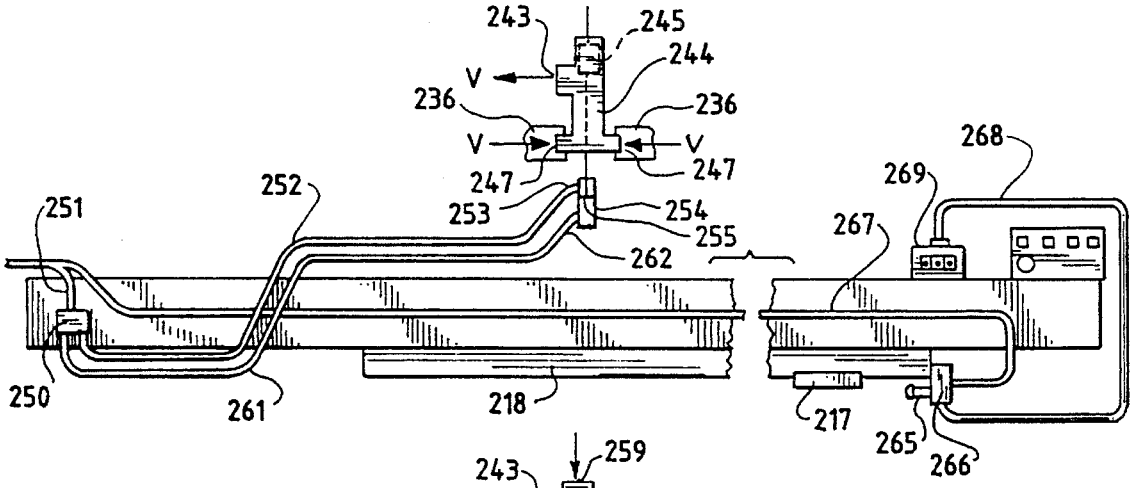
FIG. 15 gives a pneumatic circuit diagram for the valve operating the vacuum in the unloader of FIG. 14 and for a counter.

The control for the vacuum appearing in the tubes 236 and thus the hoses 231 appears in FIG. 15. The overall vacuum appears at the opening 243 of the valve 244. With the V bracket 217, and thus the unloader 216, overlying the pallet 29 as shown in FIGS. 14 and 15, the plug 245 occupies the upper position as seen in FIG. 15. This allows the vacuum at the opening 243 to transfer to the outlets 247 of the valve 244. From there, the vacuum travels through the tubes 236 ultimately to the unloading hoses 231.

Figure 16:
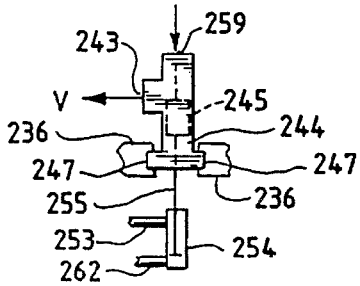
FIG. 16 shows the valve of FIG. 15 in the configuration when the unloader of FIGS. 13 and 14 releases its pieces of fabric.

After the V bracket has traveled to the left along the Tol-O-Matic cylinder 218, the pistons 224 descend out of the cylinders 223. At this point, an electrical signal to the valve 250 causes the pneumatic pressure along the line 251 to pass, on the connecting line 252, to the upper opening 253 of the cylinder 254. This retracts the piston 255 into the cylinder 254. The piston 225, connected to the plug 245, causes the latter to move downwards as well until it occupies the position shown in FIG. 16. This then blocks the openings 247 of the valve 244 from the vacuum at the inlet 243. At the same time, it passes the vacuum 243 to the outlet 258 where it exhausts to atmosphere and, in this configuration, will have no further effect. This terminates the vacuum at the tubes 231, the manifolds 235, and the hoses 231 to release the webs 22 of fabric. After this happens, the cylinders 223 retract their pistons 224. A further signal to the valve 250 causes the pneumatic pressure from the line 251 to travel along the lead 261 to the lower opening 262 of the cylinder 254 which then extends its piston 254. This pushes the plug 245 back into the configuration shown in FIG. 15 for the next pick-up.

As also seen in FIG. 15, when the V bar 217 moves to the right, or the position where it can pick up pieces of fabric 22 from the pallet 29, it also contacts the plunger 265 of the valve 266 (a Clippard MJV-3). This in turn provides a pulse of pneumatic pressure from the line 267 onto the line 268 and to the counter 269 (a Clippard PC3PM). The counter 269, in turn, can control a device such as that shown in U.S. Pat. No. 4,782,775 to C. D. Scher et al. and assigned to QST Industries, Inc. of Chicago, Ill. Upon the reaching of an appropriate count, the feed mechanism of that patent may insert a short tab of material to provide a count of the webs taken off the printing press 20.

Figure 17:
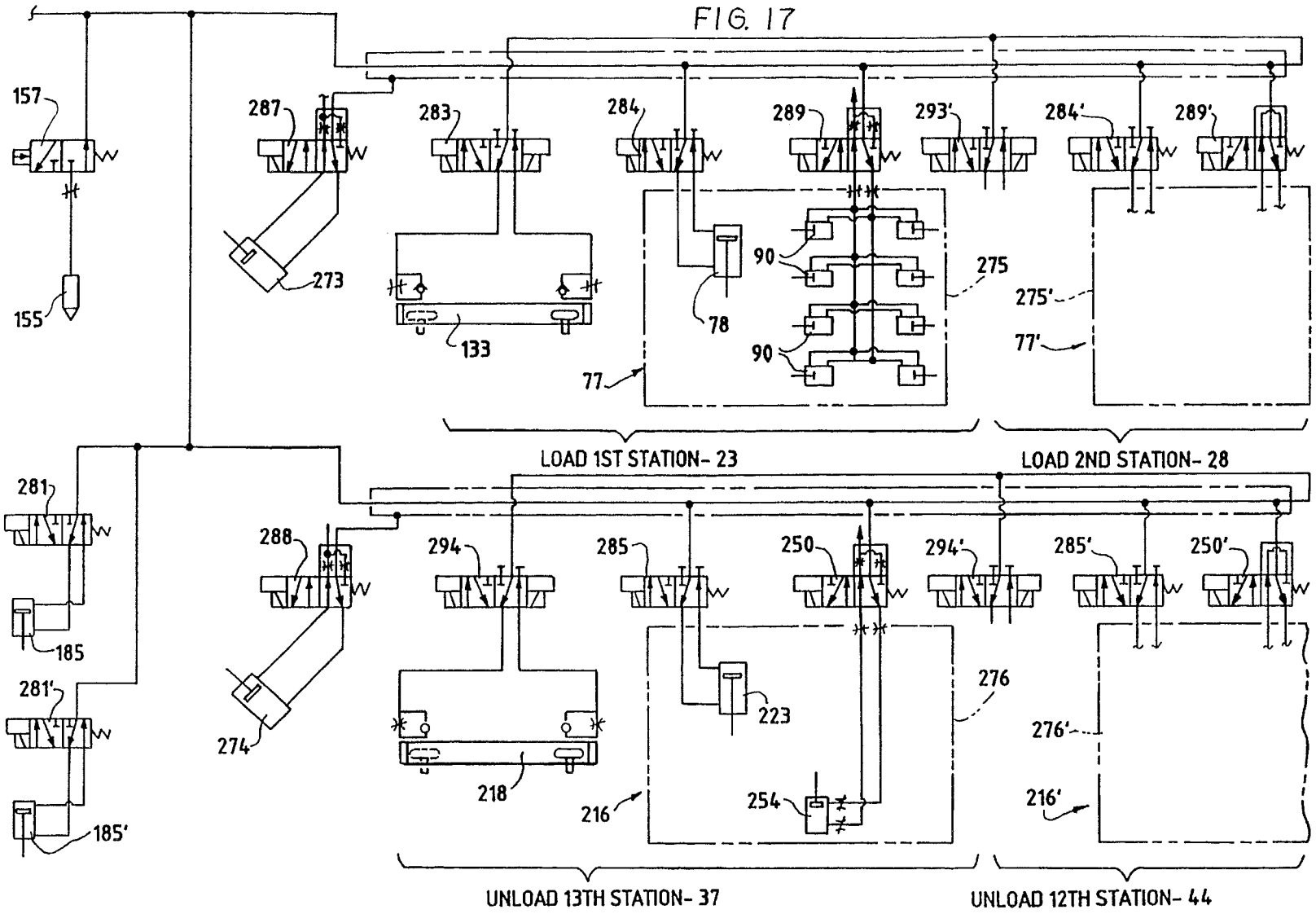
FIG. 17 provides a pneumatic circuit diagram for the operational components of the prior figures.

The pneumatic circuit diagram controlling the various cylinders discussed in the above figures appears in FIG. 17. In addition to displaying the various cylinders, it also includes the valves that control the flow of pneumatic pressure to them. In turn, all the valves include solenoids. Accordingly, they operate under electrical direction. In particular, the program for the printing press 20 provides the appropriate pulses to the valves so that they control the pneumatic pressure as appropriate to all of the cylinders shown.

In addition to the cylinders appearing in the prior figures, FIG. 17 also shows the cylinders 273 and 274. They find use at the first and second load stations 21 and 28 and the four printing stations 36, 41, 50, and 51 in FIG. 1. When the pallet 29 has reached the first load station 21, for example, the press 20 stops its motion for an operation. At that point, the cylinder 273 forces the roller 276 into the cam 73 of the edge controller 72. This provides an assuredly accurate positioning of the pallet 29 at the first load station 21 to achieve the accurate placement of the fabric webs 22.

FIG. 17 shows the cylinders 78 and 90 of the loader 77 within the outline of the box 275. The second loader 77' simply appears diagrammatically as the second box 275'. Clearly, the second loader 77' will have the same components as does the first loader 77. Similar remarks apply to the second unloader 216' and its diagrammatic box 276' containing the same components as the box 276 for the first unloader 216.

The Clippard Instrument Laboratory, Inc., of Cincinnati, Ohio, may supply all the valves shown in FIG. 17. The following serial numbers refer to Clippard's product designation. In particular, the valve 157 controlling the air to the nozzle 155 may take the form of an R711 pulse valve. A four-way solenoid valve, model 811C, may find use as the valves 281 and 282 controlling the raising solenoids 185 and 185' of the driers, including specifically, the drier 181 of FIGS. 12 and 13; the elevating cylinders 284 and 284' controlling the elevating cylinder 78 and its counterpart of the loaders 77 and 77', respectively, of FIGS. 4 and 5; and the valves 285 and 285' controlling the elevating cylinders 223 of the unloaders 216 and 216', seen in FIG. 14. The four-way solenoid valve model 45A has proven suitable as the valves 287 and 288 to control the locator cylinders 273 and 274, with the former illustrated in FIG. 5; the valves 289 and 289' controlling the gripper cylinders 90 and their counterparts of the loaders 77 and 77' of FIGS. 4 and 5; and the valves 250 and 250' for the vacuum-control cylinder 254 and its counterpart of the unloaders 216 and 216' of FIG. 14. Lastly, the four-way double solenoid valve, model 812C, finds use for the valves 93 controlling the Tol-O-Matic cylinders 133 and its counterpart at the first and second load stations 23 and 28, respectively, and the valves 294 and 294' controlling the Tol-O-Matic cylinders 218 and its counterpart at the unloading thirteenth and twelfth stations 44 and 37, respectively.

As mentioned above, all of the valves 157, 250, 250', 281, 281', 284, 284', 285, 285', 287, 288, 289, 289', 293, 293', 294 and 294', operate under the control of solenoids. They in turn responds to electrical pulses provided by the program for the press 20. Alternately, when necessary, valves of the loader 77 and the unloader 216 may submit to manual control from pulses supplied by the box 301 in FIGS. 4 and 5 and similar boxes for the other loader and the unloaders.

The general start-up and shut-down procedures have received discussion above. That showed that pallets not having fabric webs 22 upon them will not receive the operation of a station at which they sit. The following sets forth the general behavior of the components shown in FIG. 17 during continuous operation of the press 20. It also applies to so much of the start-up and shut-down procedure as appropriate. The only difference amounts to the nonperformance of certain functions at stations having pallets without fabric webs 22 on top.

Initially, the press 20 includes various strategically located position sensors. These either permit or prevent the operation of certain functions of the press 20 and the mechanisms shown in the figures. The lift cylinder 78 for the loader 77, lift cylinder 185 for the drier 181, and lift cylinder 223 for the unloader 216 all take the form of part no. MRS5171DXP from Bimba Mfg. Co., in Monee, Ill. They include Bimba read switches, part no. MRS-089-PXBC to determine the cylinders' up and down positions.

The procedures of the press include the following:

(a) The electronic control program will not allow the pallets to move for a cycle of motion ("indexing") unless the microswitches say that the loaders 77 and 77' are in their "up" and "in" (i.e. over the top of the pallet 29 or 30) position. Further, no indexing will occur unless, similarly, the unloaders 216 and 216' are at their "up" and "in" position. Lastly, the driers 181 and 181' must sit at their "up" position (recalling that they do not move translationally). Requiring all of these components to occupy their "up" position simply means that no pallet including the pallets 29 and 30 will move if any component occupies the down position which could interfere with the indexing of the pallets and result in damage to the equipment. The up position of the loaders 77 and 77' and the unloaders 216 and 216' also allow them to clear components of the press 20 as they move between their in and out positions.

(b) During indexing (i.e. a cycle of motion when the pallets move from a particular station to two down the line), the loaders 77 and 77' move to their "out" and "up" position as do the unloaders 216 and 216'. Furthermore, in the case of silk screening, the screens will receive a flood stroke which provides them with ink.

(c) At the end of a cycle of motion ("indexing"), the roller 276 fits into the notch 73 of the position tab 72 as seen in FIG. 5. This locates the pallet 29 for proper operation. Furthermore, the microswitch tells the press' controller of the fact that the roller 276 has reached its proper position and that, as a consequence, the pallet 29 sits in its proper location. Further operations may then occur.

(d) After the completion of indexing, the heaters 181 and 181' may descend and contact the fabric webs 22. They stay there long enough to effectuate the desired degree of ink curing. This may take as much as four seconds. During this time, also, the loaders 77 and 77' descend, grab their pieces 22 of material, ascend to their up position, translate to their in position, descend, deposit their fabrics 22 onto the pallets 29 and 30, and return to their "up" position. Similarly, the unloaders 216 and 216' descend, drop their pieces of fabric 22 onto the receiving bins 54 and 55, return to their up position, translate to their in position, descend to their down position to pick up further fabric webs 22, and return to their up position. When the heaters, loaders, and unloaders, have returned to their up position as indicated above, the microsensors inform the machine of the completion of the operations. This permits a further cycle of motion or indexing as set forth in paragraph (a) above.

Accordingly, what is claimed is:

1. A device for removing a fabric web from on top of a stack of fabric webs comprising:

(A) a plurality of at least three needles;

(B) retaining means, coupled to said needles, for holding said needles at three points in a first configuration, said points not lying on a straight line, said points defining an area substantially parallel to said web, said needles, when held by said retaining means, extending at a nonperpendicular angle to the surface of said web;

(C) grabbing means, coupled to said retaining means, for placing said needles under pressure in contact with said web but no deeper into said web than nine tenths of the thickness of said web and subsequently moving said needles away from said stack; and (D) extending means, coupled to said retaining means, for, with said needles in contact with said web, moving said needles to a second configuration with at least two of said points being further away from each other than in said first configuration and maintaining said needles in generally said second configuration as said grabbing means moves said needles away from said stack.

2. The device of claim 1 wherein said plurality includes at least four needles and wherein said retaining means couples to said needles and holds said needles at four points in a first configuration, no three of said points lying on a straight line.

3. The device of claim 2 including a plurality of needles at each of said four points and wherein said retaining means couples to said needles and holds a plurality of needles at each of said four points.

4. The device of claim 3 wherein said retaining means retains said needles at a nonperpendicular angle relative to said surface of said web.

5. The device of claim 4 wherein, when said needles move from said first configuration to said second configuration, two of said four points move away from the other two of said four points.

6. The device of claim 5 wherein said retaining means holds said plurality of needles at said four points in a direction towards which said needles move relative to each other when said extending means moves said needles from said first configuration to said second configuration.

7. The device of claim 6 wherein said grabbing means places said needles into said web is no deeper than about half the thickness of said web.

8. The device of claim 6 wherein, when said needles move from said first configuration to said second configuration, all of said four points move relative to said surface of said web.

9. The device of claim 6 wherein said surface of said web is substantially horizontal.

10. The device of claim 9 wherein said grabbing means, when moving said needles away from said stack, moves said needles upward in a substantially vertical direction.

11. The device of claim 10 wherein said grabbing means, after moving said needles upward in a substantially vertical direction, moves said needles in a substantially horizontal direction and afterwards in a substantially downward vertical direction after which said extending means moves said needles from said second configuration to a third configuration in a direction substantially opposite to when said extending means moves said needles from said first configuration to said second configuration.

12. The device of claim 11 further including release means, coupled to said retaining means, for, after said extending means moves said needles from said second configuration to said third configuration, applying air under pressure to said surface of said web.

13. The device of claim 6 wherein said retaining means holds said needles at an angle of about 25 degrees relative to said surface of said web.

14. The device of claim 6 wherein said grabbing means further includes spring means, coupled to said needles, for placing on said needles a downward first component of force substantially perpendicular to said surface of said web, said spring means permitting, upon the application of a second and upward component of force greater than the weight of said retaining means and said first component in a direction opposite to said first component, a lifting of said needles from said surface of said web.

15. The device of claim 6 wherein said web is a first web, said stack is a first stack, said device removes first and second fabric webs from on top of first and second stacks of fabric webs, respectively, said plurality of needles is a first plurality, said retaining means is a first retaining means, said four points are a first set of points, and said extending means is a first extending means, and further including a second plurality of at least four needles, second retaining means, coupled to said needles of said second plurality, for holding said needles of said second plurality at a second set of four points in a third configuration, no three of said points in said third configuration lying on a straight line, said points of said second set defining an area substantially parallel to said second web, said needles of said second plurality, when held by said second retaining means having an extension perpendicular to the surface of said second web no greater than about the thickness of said second web, said grabbing means coupling to said second retaining means, placing said needles of said second plurality under pressure in contact with said second web, and subsequently moving said needles of said second plurality away from said second stack as it moves said needles of said first plurality away from said first stack, and second extending means, coupled to said second retaining means, for, with said needles of said second plurality in contact with said second web, moving said needles of said second plurality to a fourth configuration with at least two of said points in said second set being further away from each other than in said third configuration and maintaining said needles in said second plurality in generally said fourth configuration as said grabbing means moves said needles of said second plurality away from said second stack.

16. The device of claim 15 wherein said grabbing means moves said needles in a substantially vertical, upward direction when it moves them away from said first and second stacks, and after moving said first and second plurality of needles upward in a substantially vertical direction, moves said needles of said first and second pluralities in a substantially horizontal direction and afterwards in a substantially downward vertical direction after which said first and second extending means move said needles of said first and second pluralities, respectively, from said second and fourth configurations, respectively, to fifth and sixth configurations, respectively, in a direction substantially opposite to when said first and second extending means move said needles of said first and second pluralities, respectively, from said first and third configurations-to said second and fourth configurations.

17. The device of claim 11 further including (a) a pallet with a surface, said extending means moving said needles from said second configuration to said third configuration when said web is in the immediate proximity of said surface of Said pallet, and (b) a drier for drying wet printing on a portion of Said web of fabric while on said surface of said pallet, said drier including a section of material with a surface, heating means, coupled to said surface of said material, for maintaining said surface of said material at an elevated temperature, and moving means, coupled to said surface of said material, for placing said surface of said material, while heated to said temperature, in contact with said portion of said web for a period of time and subsequently removing said surface of said material from said portion.

18. The device of claim 17 wherein said section of material comprises a substantially rigid block.

19. The device of claim 18 wherein said surface is substantially nontacky.

20. The device of claim 19 wherein said surface comprises a layer of a polymer adhered to metal.

21. The device of claim 20 wherein said moving means moves said surface of said material in a substantially vertical direction.

22. The device of claim 21 wherein said portion of said web is a first portion and further including printing means, coupled to said moving means, for, after said moving means has removed said surface of said material from said portion of said web of fabric, placing wet printing on a second portion of said web of fabric.

23. The device of claim 22 wherein said section of material is a first section of material with a first surface, said heating means is a first heating means, said temperature is a first temperature, and said moving means is a first moving means, and further including a second section of material with a second surface, second heating means, coupled to said second surface, for maintaining said second surface of said material at a second elevated temperature, and second moving means, coupled to said second surface of said second section of material, for placing said second surface, while heated to said second temperature, in contact with said second portion of said web of fabric for a period of time and subsequently removing said second surface from said second portion of said web of fabric.

24. The device of claim 21 wherein said web of fabric with said wet printing is substantially flat and horizontal.

25. The device of claim 21 wherein said section of material comprises a metal block.

26. The device of claim 25 wherein said polymer coating comprises a Teflon polymer.

27. The device of claim 21 wherein said wet printing comprises a water-based ink.

28. The device of claim 27 wherein said ink comprises a two-part cross-linked liquid.

29. The device of claim 27 wherein said elevated temperature is at least about 400° F.

30. The device of claim 29 wherein said period of time is at least about 4 seconds.

31. The device of claim 21 wherein said moving means further includes spring means, coupled to said block, for placing on said block a downward first component of force substantially perpendicular to said surface of said web, said spring means permitting, upon the application of a second and upward component of force greater than about said first component added to the weight of said block in a direction opposite to said first component, a lifting of said block from said surface of said web.

32. The device of claim 21 wherein said printing constitutes a pattern on said web, said pattern is placed as wet printing on a plurality of webs of fabric, and further including locating means, coupled to said moving means, for aligning said pattern on each of said webs in a particular location relative to said section of material.

33. The device of claim 32 wherein each of said webs is located on separate pallet, each of said pallets has a surface of a predetermined shape, and said locating means aligns each of said pallets relative to said section of material.

34. The device of claim 33 wherein said web is a first web of fabric, said section is a first section of material, said surface is a first surface, said rigid block is a first rigid block, said heating means is a first heating means, and said pallet carrying said first web carries a second web of fabric with wet printing on a second portion, and further including a second section of material with a second surface forming part of a second rigid block and second heating means, coupled to said second surface, for maintaining said second surface at about said elevated temperature, said moving means coupling to said second surface and placing said second surface, while heated to about said temperature, in contact with said second portion of said second web for about said period of time and subsequently removing said second surface from said second portion.

35. A device for drying wet printing on a portion of a web of fabric comprising:

(A) a section of material with a surface;

(B) heating means, coupled to said surface, for maintaining said surface of said material at an elevated temperature; and (C) moving means, coupled to said surface of said material, for placing said surface, while heated to said temperature, in contact with said portion of said web for a period of time and subsequently removing said surface from said portion.

36. The device of claim 35 wherein said section of material comprises a substantially rigid block.

37. The device of claim 36 wherein said surface is substantially nontacky.

38. The device of claim 37 wherein said surface comprises a layer of a polymer adhered to metal.

39. The device of claim 38 wherein said moving means moves said surface of said material in a substantially vertical direction.

40. The device of claim 39 wherein said portion of said web is a first portion and further including printing coupled to said moving means, for, after said moving means has removed said surface of said material from said portion of said web of fabric, placing wet printing on a second portion of said web of fabric.

41. The device of claim 40 wherein said section of material is a first section of material with a first surface, said heating means is a first heating means, said temperature is a first temperature, and said moving means is a first moving means, and further including a second section of material with a second surface, second heating means, coupled to said second surface, for maintaining said second surface of said material at a second elevated temperature, and second moving means, coupled to said second surface of said second section of material, for placing said second surface, while heated to said second temperature, in contact with said second portion of said web of fabric for a period of time and subsequently removing said second surface from said second portion of said web of fabric.

42. The device of claim 39 wherein said web of fabric with said wet printing is substantially flat and horizontal.

43. The device of claim 39 wherein said section of material comprises a metal block.

44. The device of claim 43 wherein said polymer coating comprises a Teflon polymer.

45. The device of claim 39 wherein said wet printing comprises a water-based ink.

46. The device of claim 45 wherein said ink comprises a two-part cross-linked liquid.

47. The device of claim 45 wherein said elevated temperature is at least about 400° F.

48. The device of claim 47 wherein said period of time is at least about 4 seconds.

49. The device of claim 39 wherein said moving means further includes spring means, coupled to said block, for placing on said block a downward first component of force substantially perpendicular to said surface of said web, said spring means permitting, upon the application of a second and upward component of force greater than about said first component added to the weight of said block in a direction opposite to said first component, a lifting of said block from said surface of said web.

50. The device of claim 39 wherein said printing constitutes a pattern on said web, said pattern is placed as wet printing on a plurality of webs of fabric, and further including locating means, coupled to said moving means, for aligning said pattern on each of said webs in a particular location relative to said section of material.

51. The device of claim 50 wherein each of said webs is located on separate pallet, each of said pallets has a surface of a predetermined shape, and said locating means aligns each of said pallets relative to said section of material.

52. The device of claim 51 wherein said web is a first web of fabric, said section is a first section of material, said surface is a first surface, said rigid block is a first rigid block, said heating means is a first heating means, and said pallet carrying said first web carries a second web of fabric with wet printing on a second portion, and further including a second section of material with a second surface forming part of a second rigid block and second heating means, coupled to said second surface, for maintaining said second surface at about said elevated temperature, said moving means coupling to said second surface and placing said second surface, while heated to about said temperature, in contact with said second portion of said second web for about said period of time and subsequently removing said second surface from said second portion.

53. The device of claim 38 further comprising a fabric-web remover including:

(A) a plurality of at least three needles;

(B) retaining means, coupled to said needles, for holding said needles at three points in a first configuration, said points not lying on a line, said points defining an area substantially parallel to said web, said needles, when held by said retaining means, having an extension perpendicular to the surface of said no greater than about the thickness of said web;

(C) grabbing means, coupled to said retaining means, for placing said needles under pressure in contact with said web and subsequently moving said needles away from said supporting surface; and (D) extending means, coupled to said retaining means, for, with said needles in contact with said web, moving said needles to a second configuration with at least two of said points being further away from each other than in said first configuration and maintaining said needles in generally said second configuration as said grabbing means moves said needles away from said supporting surface.

54. A method of removing a fabric web from on top of a stack of fabric webs comprising:

(A) placing a plurality of at least three needles at three points occupying a first configuration and not lying on a straight line, in contact and under pressure with the surface of said web, at a nonperpendicular angle to said surface of said web and no deeper into said web than nine tenths of the thickness of said web;

(B) moving said needles, while in contact with said surface of said web, to a second configuration with at least two of said points in said second configuration being further away from each other than in said first configurations; and (C) with said needles in said second configuration, moving said needles away from said stack.

55. The method of claim 54 wherein said plurality includes at least four needles at four points with, in said first configuration, no three points lying on a straight line.

56. The method of claim 55 further including placing a plurality of needles at each of said points.

57. The method of claim 56 wherein said needles are placed at a nonperpendicular angle relative to said surface of said web.

58. The method of claim 57 wherein, when said needles are moved from said first configuration to said second configuration, two of said four points are moved away from the other two of said four points.

59. The method of claim 58 wherein said plurality of needles at said four points are held in a direction towards which said needles are moved relative to each other when moving from said first configuration to said second configuration.

60. The method of claim 59 wherein the said needles are placed no deeper into said web than about half the thickness of said web.

61. The method of claim 59 wherein, when said needles are moved from said first configuration to said second configuration, all of said four points are moved relative to said surface of said web.

62. The method of claim 59 wherein said surface of said web is substantially horizontal.

63. The method of claim 62 wherein, when said needles are moved away from said stack, they are moved in a substantially vertical, upward direction.

64. The method of claim 63 wherein, after said needles tare moved upward in a substantially vertical direction, said needles are moved in a substantially horizontal direction and afterwards in a substantially downward vertical direction after which said needles are moved from said second configuration to a third configuration in a direction substantially opposite to when said needles are moved from said first configuration to said second configuration.

65. The method of claim 64 further including, after said needles are moved from said second configuration to said third configuration, applying air under pressure to said surface of said web.

66. The method of claim 59 wherein said needles are held at an angle of about 25 degrees relative to said surface of said web.

67. The method of claim 59 further including placing on said needles a downward first component of spring force substantially perpendicular to said surface of said web, said first component of force permitting, upon the application of a second and upward component of force greater than said first component in a direction opposite to said first component, a lifting of said needles from said surface of said web.

68. The method of claim 59 wherein said web is a first web and said stack is a first stack, said first and second fabric webs are removed from on top of said first and second stacks of fabric webs, respectively, said plurality of needles is a first plurality of at least four needles, and said four points are a first set of points, and further including holding a second plurality of needles at a second set of four points in a third configuration, no three of said points in said third configuration lying on a straight line, said points of said second set defining an area substantially parallel to said second web, said needles of said second plurality having an extension perpendicular to the surface of said second web no greater than about the thickness of said second web, and placing said needles of said second plurality under pressure in contact with said second web and subsequently moving said needles of said second plurality away from said second stack, and with said needles of said second plurality in contact with said second web, moving said needles of said second plurality to a fourth configuration with at least two of said points in said second set being further away from each other than in said third configuration and maintaining said needles in said second plurality in generally said fourth configuration while moving said needles of said second plurality away from said second stack.

69. The method of claim 68 wherein, after said first and second plurality of needles are moved upward in a substantially vertical direction, said needles of said first and second pluralities are moved in a substantially horizontal direction and afterwards in a substantially downward vertical direction after which said needles of said first and second pluralities, respectively, are moved from said second and fourth configurations, respectively, to fifth and sixth configurations, respectively, in a direction substantially opposite to when said needles of said first and second pluralities, respectively, are moved from said first and third configurations to said second and fourth configurations.

70. The method of claim 59 wherein said needles are moved from said second configuration to said third configuration when said web is in the immediate proximity of said surface of a pallet and further including drying wet printing on a portion of said web of fabric so dried while on said surface of said pallet by heating the surface of a section of material to a predetermined temperature contacting said portion of said web with said surface of said material, while heated to said temperature for a period of time, and subsequently removing said surface of said material from said portion.

71. The method of claim 70 wherein said surface comprises a layer of a polymer adhered to metal.

72. The method of claim 71 wherein said surface of said material is moved in a substantially vertical direction.

73. The method of claim 72 wherein said portion of said web is a first portion and further including, after said surface of said material has been removed from said portion of said web of fabric, placing wet printing on a second portion of said web of fabric.

74. The method of claim 73 wherein said section of material is a first section of material with a first surface, and said temperature is a first temperature, and further including maintaining a second surface of a second section of material at a second elevated temperature, placing said second surface, while heated to said second temperature, in contact with said second portion of said web of fabric for a period of time and subsequently removing said second surface from said second portion of said web of fabric.

75. The method of claim 72 wherein said web of fabric with said wet printing is substantially flat and horizontal.

76. The method of claim 72 wherein said section of material comprises a metal block.

77. The method of claim 72 wherein said wet printing comprises a water-based ink.

78. The method of claim 77 wherein said elevated temperature is at least about 400° F.

79. The method of claim 78 wherein said period of time is at least about 4 seconds.

80. The method of claim 72 wherein said printing constitutes a pattern on said web, said pattern is placed as wet printing on a plurality of webs of fabric, and further including aligning said pattern on each of said webs in a particular location relative to said section of material.

81. The method of claim 80 wherein each of said webs is located on a separate pallet, each of said pallets has a surface of a similar shape, and further including aligning each of said pallets relative to said section of material.

82. The method of claim 81 wherein said web is a first web of fabric, said section is a first section of material, said surface is a first surface, said rigid block is a first rigid block, and said pallet carrying said first web carries a second web of fabric with wet printing on a second portion, and further including maintaining a second surface of a second section of material at about said elevated temperature, placing said second surface, while heated to about said temperature, in contact with said second portion of said second web for about said period of time, and subsequently removing said second surface from said second portion.

83. A method of drying wet printing on a portion of a web of fabric comprising:

(A) heating the surface of a section of material to a selected temperature;

(B) contacting said portion of said web of fabric with said surface while at said temperature for a period of time; and (C) subsequently removing said surface from said web of fabric.

84. The method of claim 83 wherein said section of material comprises a substantially rigid block.

85. The method of claim 84 wherein said surface is substantially nontacky.

86. The method of claim 85 wherein said surface comprises a layer of a polymer adhered to metal.

87. The method of claim 86 wherein said surface of said material is moved in a substantially vertical direction.

88. The method of claim 87 wherein said portion of said web is a first portion and further including, after said surface of said material has been removed from said portion of said web of fabric, placing wet printing on a second portion of said web of fabric.

89. The method of claim 88 wherein said section of material is a first section of material with a first surface, and said temperature is a first temperature, and further including maintaining a second surface of a second section of material at a second elevated temperature, placing said second surface, while heated to said second temperature, in contact with said second portion of said web of fabric for a period of time, and subsequently removing said second surface from said second portion of said web of fabric.

90. The method of claim 87 wherein said web of fabric with said wet printing is substantially flat and horizontal.

91. The method of claim 87 wherein said section of material comprises a metal block.

92. The method of claim 91 wherein said polymer coating comprises a Teflon polymer.

93. The method of claim 87 wherein said wet printing comprises a water-based ink.

94. The method of claim 93 wherein said ink comprises a two-part cross-linked liquid.

95. The method of claim 93 wherein said elevated temperature is at least about 400° F.

96. The method of claim 95 wherein said period of time is at least about 4 seconds.

97. The method of claim 87 further including placing on said block a downward first component of force substantially perpendicular to said surface of said web, said first component of force, permitting, upon the application of a second and upward component of force greater than about said first component added to the weight of said block in a direction opposite to said first component, a lifting of said block from said surface of said web.

98. The method of claim 87 wherein said printing constitutes a pattern on said web, said pattern is placed as wet printing on a plurality of webs of fabric, and further including aligning said pattern on each of said webs in a particular location relative to said section of material.

99. The method of claim 98 wherein each of said webs is located on a separate pallet, each of said pallets has a surface of a predetermined shape, and further including aligning each of said pallets relative to said section of material.

100. The method of claim 99 wherein said web is a first web of fabric, said section is a first section of material, said surface is a first surface, said rigid block is a first rigid block, and said pallet carrying said first web carries a second web of fabric with wet printing on a second portion, and further including maintaining a second surface of a second section of material at about said elevated temperature, placing said second surface, while heated to about said temperature, in contact with said second portion of said second web for about said period of time, and subsequently removing said second surface from said second portion.

101. A device for removing a fabric web from on top of a supporting surface comprising:

(A) a plurality of at least three needles;

(B) retaining means, coupled to said needles, for holding said needles at three points in a first configuration, said points not lying on a straight line, said points defining an area substantially parallel to said web, said needles, when held by said retaining means, extending at a nonperpendicular angle to the surface of said web;

(C) grabbing means, coupled to said retaining means, for placing said needles under pressure in contact with said web but no deeper into said web than nine tenths of the thickness of said web and subsequently moving said needles away from said supporting surface; and (D) extending means, coupled to said retaining means, for, with said needles in contact with said web, moving said needles to a second configuration with at least two of said points being further away from each other than in said first configuration and maintaining said needles in generally said second configuration as said grabbing means moves said needles away from said supporting surface.

102. The device of claim 101 wherein said plurality includes at least four needles and wherein said retaining means couples to said needles and holds said needles at four points in a first configuration, no three of said points lying on a straight line.

103. The device of claim 102 including a plurality of needles at each of said four points and wherein said retaining means couples to said needles and holds a plurality of needles at each of said four points.

104. The device of claim 103 wherein said retaining means retains said needles at a nonperpendicular angle relative to said surface of said web.

105. The device of claim 104 wherein, when said needles move from said first configuration to said second configuration, two of said four points move away from the other two of said four points.

106. The device of claim 105 wherein said retaining means holds said plurality of needles at said four points in a direction towards which said needles move relative to each other when said extending means moves said needles from said first configuration to said second configuration.

107. The device of claim 106 wherein said grabbing means places said needles into said web no deeper than about half the thickness of said web.

108. The device of claim 106 wherein, when said needles move from said first configuration to said second configuration, all of said four points move relative to said surface of said web.

109. The device of claim 106 wherein said surface of said web is substantially horizontal.

110. The device of claim 109 wherein said grabbing means, when moving said needles away from said supporting surface, moves said needles upward in a substantially vertical direction.

111. The device of claim 110 wherein said grabbing means, after moving said needles upward in a substantially vertical direction, moves said needles in a substantially horizontal direction and afterwards in a substantially downward vertical direction after which said extending means moves said needles from said second configuration to a third configuration in a direction substantially opposite to when said extending means moves said needles from said first configuration to said second configuration.

112. The device of claim 111 further including release means, coupled to said retaining means, for, after said extending means moves said needles from said second configuration to said third configuration, applying air under pressure to said surface of said web.

113. The device of claim 106 wherein said retaining means holds said needles at an angle of about 25 degrees relative to said surface of said web.

114. The device of claim 106 wherein said grabbing means further includes spring means, coupled to said needles, for placing on said needles a downward first component of force substantially perpendicular to said surface of said web, said spring means permitting, upon the application of a second and upward component of force greater than the weight of said retaining means and said first component in a direction opposite to said first component, a lifting of said needles from said surface of said web.

115. The device of claim 106 wherein said web is a first web, said supporting surface is a first supporting surface, said device removes first and second fabric webs from on top of first and second supporting surfaces of fabric webs, respectively, said plurality of needles is a first plurality, said retaining means is a first retaining means, said four points are a first set of points, and said extending means is a first extending means, and further including a second plurality of at least four needles, second retaining means, coupled to said needles of said second plurality, for holding said needles of said second plurality at a second set of four points in a third configuration, no three of said points in said third configuration lying on a straight line, said points of said second set defining an area substantially parallel to said second web, said needles of said second plurality, when held by said second retaining means having an extension perpendicular to the surface of said second web no greater than about the thickness of said second web, said grabbing means coupling to said second retaining means, placing said needles of said second plurality under pressure in contact with said second web, and subsequently moving said needles of said second plurality away from said second supporting surface as it moves said needles of said first plurality away from said first supporting surface, and second extending means, coupled to said second retaining means, for, with said needles of said second plurality in contact with said second web, moving said needles of said second plurality to a fourth configuration with at least two of said points in said second set being further away from each other than in said third configuration and maintaining said needles in said second plurality in generally said fourth configuration as said grabbing means moves said needles of said second plurality away from said second supporting surface.

116. The device of claim 115 wherein said grabbing means moves said needles in a substantially vertical, upward direction when it moves them away from said first and second supporting surfaces, and after moving said first and second plurality of needles upward in a substantially vertical direction, moves said needles of said first and second pluralities in a substantially horizontal direction and afterwards in a substantially downward vertical direction after which said first and second extending means move said needles of said first and second pluralities, respectively, from said second and fourth configurations, respectively, to fifth and sixth configurations, respectively, in a direction substantially opposite to when said first and second extending means move said needles of said first and second pluralities, respectively, from said first and third configurations to said second and fourth configurations.

117. A method of removing a fabric web from on top of a supporting surface comprising:

(A) placing a plurality of at least three needles occupying a first configuration, not lying in a line, in contact and under pressure with the surface of said web at a nonperpendicular angle to said surface of said web and no deeper into said web than nine tenths of the thickness of said web;

(B) moving said needles, while in contact with said surface of said web, to a second configuration with at least two of said points in said second configuration being further away from each other than in said first configurations; and (C) with said needles in said second configuration, moving said needles away from said supporting surface.

118. The method of claim 117 wherein said plurality includes at least four needles at four points with, in said first configuration, no three points lying on a straight line.

119. The method of claim 118 further including placing a plurality of needles at each of said points.

120. The method of claim 119 wherein said needles are placed at a nonperpendicular angle relative to said surface of said web.

121. The method of claim 120 wherein, when said needles are moved from said first configuration to said second configuration, two of said four points are moved away from the other two of said four points.

122. The method of claim 121 wherein said plurality of needles at said four points are held in a direction towards which said needles are moved relative to each other when moving from said first configuration to said second configuration.

123. The method of claim 122 wherein the extension of said needles in a direction perpendicular to said surface of said web is no greater than about half the thickness of said web.

124. The method of claim 122 wherein, when said needles are moved from said first configuration to said second configuration, all of said four points are moved relative to said surface of said web.

125. The method of claim 122 wherein said surface of said web is substantially horizontal.

126. The method of claim 125 wherein, when said needles are moved away from said supporting surface, they are moved in a substantially vertical, upward direction.

127. The method of claim 126 wherein, after said needles are moved upward in a substantially vertical direction, said needles are moved in a substantially horizontal direction and afterwards in a substantially downward vertical direction after which said needles are moved from said second configuration to a third configuration in a direction substantially opposite to when said needles are moved from said first configuration to said second configuration.

128. The method of claim 127 further including, after said needles are moved from said second configuration to said third configuration, applying air under pressure to said surface of said web.

129. The method of claim 122 further including placing on said needles a downward first component of spring force substantially perpendicular to said surface of said web, said force permitting, upon the application of a second and upward component of force greater than said first component in a direction opposite to said first component, a lifting of said needles from said surface of said web.

130. The method of claim 122 wherein said web is a first web and said supporting surface is a first supporting surface, said first and second fabric webs are removed from on top of said first and second supporting surfaces of fabric webs, respectively, said plurality of needles is a first plurality of at least four needles, and said four points are a first set of points, and further including holding a second plurality of needles at a second set of four points in a third configuration, no three of said points in said third configuration lying on a straight line, said points of said second set defining an area substantially parallel to said second web, said needles of said second plurality having an extension perpendicular to the surface of said second web no greater than about the thickness of said second web, and placing said needles of said second plurality under pressure in contact with said second web and subsequently moving said needles of said second plurality away from said second supporting surface, and with said needles of said second plurality in contact with said second web, moving said needles of said second plurality to a fourth configuration with at least two of said points in said second set being further away from each other than in said third configuration and maintaining said needles in said second plurality in generally said fourth configuration while moving said needles of said second plurality away from said second supporting surface.

131. The method of claim 130 wherein, after said first and second plurality of needles are moved upward in a substantially vertical direction, said needles of said first and second pluralities are moved in a substantially horizontal direction and afterwards in a substantially downward vertical direction after which said needles of said first and second pluralities, respectively, are moved from said second and fourth configurations, respectively, to fifth and sixth configurations, respectively, in a direction substantially opposite to when said needles of said first and second pluralities, respectively, are moved from said first and third configurations to said second and fourth configurations.

132. A device for removing a porous web from a surface where a first negative partial pressure is applied from said surface to a first side of said web in contact with said surface, said first negative partial pressure retaining said web at said surface, comprising:

(A) vacuum means for applying to the second side of said web a second negative partial pressure greater in magnitude than said first negative partial pressure; and (B) moving means, coupled to said second vacuum means, for, while said first negative partial pressure is applied to said first surface of said web and said vacuum means applies said second negative partial pressure to said second side of said web, moving said vacuum means away from said surface.

133. The device of claim 132 wherein said surface is substantially horizontal and pointing upwards and said web is on top of said surface.

134. The device of claim 133 wherein said moving means, when moving said vacuum means away from said surface, moves said vacuum means in a substantially vertical, upward direction.

135. The device of claim 134 wherein said first negative partial pressure is applied at first discreet locations at said surface and said vacuum means applies said second negative partial pressure at second discreet locations to said second side of said web.

136. The device of claim 135 wherein at least a portion of said second discreet locations are located at about the same locations as a portion of said first discreet locations.

137. The device of claim 136 wherein said first negative partial pressure is applied to said first side of said web at holes located in said surface.

138. The device of claim 137 wherein said vacuum means applies said second negative partial pressure at hoses overlying at least a portion of said holes in said surface.

139. The device of claim 135 wherein said moving means, after moving said vacuum means away from said surface, moves said vacuum means substantially horizontally and said vacuum means, after said moving means has moved said vacuum means horizontally, stops applying said second negative partial pressure to said second side of said web.

140. A method of removing a porous web from a surface where a first negative partial pressure retains a first side of said web at said surface comprising:

(A) applying with a vacuum means to the second side of said web a second negative partial pressure greater in magnitude than said first negative partial pressure while said first negative partial pressure retains said first side of said web at said surface; and (B) while said vacuum means applies said second negative partial pressure to said second side of said web, moving said vacuum means away from said surface.

141. The method of claim 140 wherein said surface is substantially horizontal and pointing upwards and said web is on top of said surface.

142. The method of claim 141 wherein, when said vacuum means is moved away from said surface, said vacuum means moves in a substantially vertical, upward direction.

143. The method of claim 142 wherein said first negative partial pressure appears at a first set of discreet locations at said surface and said vacuum means applies said second negative partial pressure at a second set of discreet locations to said second side of said web.

144. The method of claim 143 wherein at least a portion of said second set of discreet locations are located at the same locations as a portion of said first set of discreet locations.

145. The method of claim 144 wherein said first negative partial pressure is applied to said first side of said web at holes located in said surface.

146. The method of claim 145 wherein said second negative partial pressure is applied through hoses overlying at least a portion of said holes in said surface.

147. The method of claim 143 wherein said vacuum means, after moving away from said surface, is moved substantially horizontally and, after said vacuum means is moved substantially horizontally, the application of said second negative partial pressure to said second side of said web is discontinued.

* * * * *